US006322851B1

(12) United States Patent
Adachi et al.

(10) Patent No.: US 6,322,851 B1
(45) Date of Patent: Nov. 27, 2001

(54) MANUFACTURING PROCESS FOR LEATHER-LIKE SHEET

(75) Inventors: Hideaki Adachi; Mitsuru Kato; Yoshihiro Tamba, all of Okayama-ken (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 09/330,062

(22) Filed: Jun. 11, 1999

(30) Foreign Application Priority Data

Jun. 30, 1998 (JP) ..... 10-199698
Jun. 30, 1998 (JP) ..... 10-199699

(51) Int. Cl.[7] ..... B05D 7/04

(52) U.S. Cl. ..... 427/246; 427/377; 427/389.9; 427/412; 427/419.7

(58) Field of Search ..... 427/246, 412, 427/419.7, 377, 389.9

(56) References Cited

U.S. PATENT DOCUMENTS 4,366,192 * 12/1982 McCartney ..... 427/246
4,833,012 * 5/1989 Makimura et al. ..... 428/288
5,503,899 * 4/1996 Ashida et al. ..... 428/151
5,952,413 * 9/1999 Vogt ..... 524/306
5,993,944 * 11/1999 Honna et al. ..... 428/198

* cited by examiner

*Primary Examiner*—Shrive P. Beck
*Assistant Examiner*—Kirsten A. Crockford
(74) *Attorney, Agent, or Firm*—Oblon, Spivak, McClelland, Maier & Neustadt, P.C.

(57) ABSTRACT

In a process for making a leather-like sheet by impregnating a fibrous substrate with a polyurethane emulsion, heat gellable polyurethane emulsion having a specific modulus of elasticity is employed as the polyurethane emulsion, and either of following methods (1) and (2) is also employed:

(1) before impregnation of the polyurethane emulsion, the fibrous substrates are pretreated with a surfactant having a function of inhibiting adhesion between fibers and polyurethane (2) in addition to the above modulus of elasticity, the polyurethane emulsion has a specific α dispersion temperature, the fibrous substrates are composed of microfine fiber-forming fibers, and after coagulation of polyurethane emulsion, the fibers are converted to microfine fibers.

The leather-like sheets obtained according to this invention exhibits natural leather-like softness and hand touchness as well as excellent physical properties such as bending fatigue resistance.

11 Claims, 3 Drawing Sheets

MANUFACTURING PROCESS FOR LEATHER-LIKE SHEET

BACKGROUND OF THE INVENTION

1. Field of the Invention

The present invention generally relates to a process for making a leather-like sheet, and to a leather-like sheet made thereby. More particularly, the invention relates to a manufacturing process thereof by impregnating a fibrous substrate with a polyurethane emulsion followed by coagulation. The leather-like sheet obtainable with the present invention exhibits a significantly improved softness and fulfillment feeling, a superior hand touch and physical properties extremely close to natural leather as compared with the conventional leather-like sheet obtainable in the prior art.

2. Description of the Prior Art

Artificial leather-like sheets have been commonly manufactured by impregnating fibrous substrates with resinous material, such as polyurethane as a bonding material. Typical examples of these manufacturing processes include: (a) a wet coagulation process in which fibrous substrate is impregnated with resin solution such as solution of polyurethane dissolved into an organic solvent such as dimethylformamide, and subsequently coagulated in non-solvent media, such as water; and (b) a dry coagulation process in which fibrous substrate is impregnated with resin solution such as polyurethane solution in an organic solvent, or with emulsion dispersed in water, and subsequently dried.

As for a wet coagulation process, Japanese Patent Publication Sho 45-33797 discloses a manufacturing process for making a sheet material using a silicone resin-treated fibrous substrate which is impregnated with a polymer solution or an emulsion based on polyurethane elastomer followed by coagulation. The wet coagulation process can provide better hand touch of natural leather compared with the dry coagulation process, but is disadvantageous in that it is inferior in productivity, and requires the use of an organic solvent such as dimethylformamide.

In the dry coagulation process, the use of an organic solvent can be avoided by using an emulsion. However, the use of emulsion tends to give significantly inferior hand touch and fulfillment feeling compared with the wet coagulation process. In the dry coagulation process, during drying stage resin tends to exist locally in the fibrous substrate thereby bonding fibers tightly at localized sites, and causing loss of softness of the sheet. This is evident from FIG. 1 which shows an electron micrograph of a cross section of a conventional leather-like sheet obtained by impregnating fibrous substrate with a general-purpose emulsion. In the conventional dry coagulation process with a resin emulsion, when the amount of resin to be stuck onto the fibers is reduced not to lose softness, the hand of fibrous substrate itself, such as nonwoven fabric appears, thereby failing to provide the hand touch of natural leather. On the other hand, when it is tried to obtain enough fulfillment feeling to provide the hand touch of natural leather, softness of the sheet will have to be sacrificed. In both the cases, it is impossible to obtain a highly desirable quality of hand touch of natural leather.

In the dry coagulation process using an emulsion resin, some consideration is given to add a softening agent after the resin impregnation step to provide desired softness. However, this requires an additional step of adding the same, which will lower the productivity, and is unlikely to afford the desired high-grade hand touch of natural leather.

On the other hand, when microfine fibers are used in the fibrous substrate, a more natural hand touch similar to those of natural leather can be obtained. Therefore, this technique is now being used to manufacture a high quality suede-like artificial leather. The followings are some typical examples of manufacturing processes hitherto used for the above.

(1) First, a resin such as polyurethane is added to a microfine fiber forming fibrous substrate of sea-island type, which is composed of composite spun fibers or mixed spun fibers. After the addition of the resin, the sea component is dissolved away or decomposed with an organic solvent or aqueous alkaline solution to leave the island component remaining as microfine fibers.

(2) Fibrous substrate is made in advance by using microfine fibers already prepared, and then impregnated with a resin such as polyurethane.

The method (1) described above tends to give a sheet of harder hand because the resin penetrates into microfine fiber bundles during the processing step and are held tightly in the fiber bundles. If the amount of the resin is reduced to improve softness, hand touch of the sheet becomes similar to that of the substrate itself lacking fulfillment feeling.

The softness may be improved by adding a softening agent after the fibrous substrate is impregnated. However, this requires an additional treatment step, lowers the productivity, and is unlikely to afford the desired high-grade hand touch similar to natural leather.

As for the method described above in (1), Japanese Kokai (laid-open) Publication H9-132876 proposes a process of manufacturing an artificial leather comprising the steps of:

(1) impregnating a nonwoven fabric composed of a fiber which consists of at least two types of polymers with an aqueous polyurethane emulsion made of an aliphatic diisocyanate, polytetramethylene glycol and an aliphatic diamine; and (2) dissolving or decomposing part of the polymer of the fiber of the above impregnated fabric with an organic solvent or an aqueous alkaline solution.

Unfortunately, the sheet obtained by the process described above doe5 not provide adequate softness and fulfillment feeling desired for high quality artificial leather.

As for the method described above in (2), Japanese Kokai (laid open) Publication H6-316877, and Japanese Kokai (laid open) Publication H7-229071 disclose processes for making artificial leather comprising the steps of:

(1) impregnating a nonwoven sheet with an aqueous polyurethane emulsion mixed with inorganic salts, wherein said nonwoven sheet is composed substantially of a fiber layer made of microfine fibers of less than 0.5 denier, and said polyurethane emulsion has an average particle size of 0.1–2.0 $\mu$m; and (2) heating the above impregnated sheet followed by drying.

However, the process described above does not provide an artificial leather of enough softness and fulfillment feeling, failing to improve hand touch to a satisfactory level.

In order to ensure good quality, the wet coagulation process has been exclusively used in the industry to date to manufacture artificial leather even though it has lower productivity, and requires the use-of an organic solvent for the resin solution to be used for impregnation of the substrate.

However, from the standpoint of reducing solvent emission, improving safety in working environment, and streamlining the production processes, the use of the aqueous emulsion as described in the dry coagulation process is more preferable since the process does not require the use of solvent in impregnation and coagulation steps.

It is, therefore, strongly desired to develop a process capable of manufacturing high quality leather-like sheet having excellent softness and fulfillment feeling using an aqueous emulsion.

SUMMARY OF THE INVENTION

Accordingly, an object of this invention is to develop a manufacturing process for making a high quality leather-like sheet comprising the steps of impregnating a fibrous substrate with an aqueous emulsion, and subsequently heat coagulating it. Another object of this invention is to provide said leather-like sheet having an excellent hand touch, and physical properties with softness and fulfillment feeling similar to natural leather.

More specifically, it is an object of this invention to develop a manufacturing process for making a leather-like sheet involving a fibrous substrate which is pretreated with a fiber treatment agent having a property of hindering adhesion between fibers and polyurethane (hereinafter called Fibrous Substrate (I)), and said fibrous substrate being subsequently impregnated with a polyurethane emulsion (hereinafter called Polyurethane Emulsion (I)) and then coagulated, wherein:

(i) said polyurethane emulsion is heat gellable type; and (ii) a film prepared by drying said polyurethane emusion at 50° C. has a modulus of elasticity of $2.0\times10^7$ to $5.0\times10^8$ dyn/cm$^2$ at 90° C. at a thickness of 100 $\mu$m.

Another specific object of this invention is to develop a manufacturing process for making a leather-like sheet using a fibrous substrate (hereinafter called Fibrous Substrate (II)) made of microfine fibers which are made by the processes comprising the steps of:

(1) impregnating a fibrous substrate made of microfine fiber-forming fibers with polyurethane emulsion (hereinafter called Polyurethane Emulsion (II)) meeting the conditions (i) to (iv) below;

(i) Said polyurethane emulsion is a heat gellable type.

(ii) A film prepared by drying said polyurethane emusion at 50° C. has a modulus of elasticity of $2.0\times10^7$ to $5.0\times10^8$ dyn/cm$^2$ at 90° C. at a thickness of 100 $\mu$m.

(iii) A film prepared by drying said polyurethane emulsion at 50° C. has a modulus of elasticity of at least $1.0\times10^7$ dyn/cm$^2$ at 160° C. at a thickness of 100 $\mu$m.

(iv) A film having a thickness of 100 $\mu$m prepared by drying said polyurethane emulsion at 50° C. gives $\alpha$ dispersion temperature (T $\alpha$) of −30° C. or lower.

(2) coagulating the polyurethane; and (3) converting the microfine fiber-forming fibers to microfine fibers.

In addition to the development of manufacturing processes, another aspect of this invention is concerned with a leather-like sheet material which can be manufactured by the process described above. The leather-like sheet made by the manufacturing process described in this invention exhibits an adequate softness and fulfillment feeling giving hand touch similar to those of natural leather as well as excellent dynamic properties, such as anti-inflection property.

Furthermore, it is now possible with this invention to use aqueous polyurethane emulsion in the impregnation of fibrous substrate, thus making it possible to dispense with an organic solvent. In addition, coagulation of polyurethane emusion impregnated into the fibrous substrate can be made without using an organic solvent. For example, the coagulation can be made by processes such as immersing the substrate into warm water, spraying steam, or drying with heated air.

Therefore, it is now possible with this invention to reduce environmental contamination associated with the use of solvent, to streamline the manufacturing processes, and to improve productivity while producing a high quality leather-like sheet at a low cost.

DETAILED DESCRIPTION OF THE PREFERRED EMBODIMENT

Figure 1:
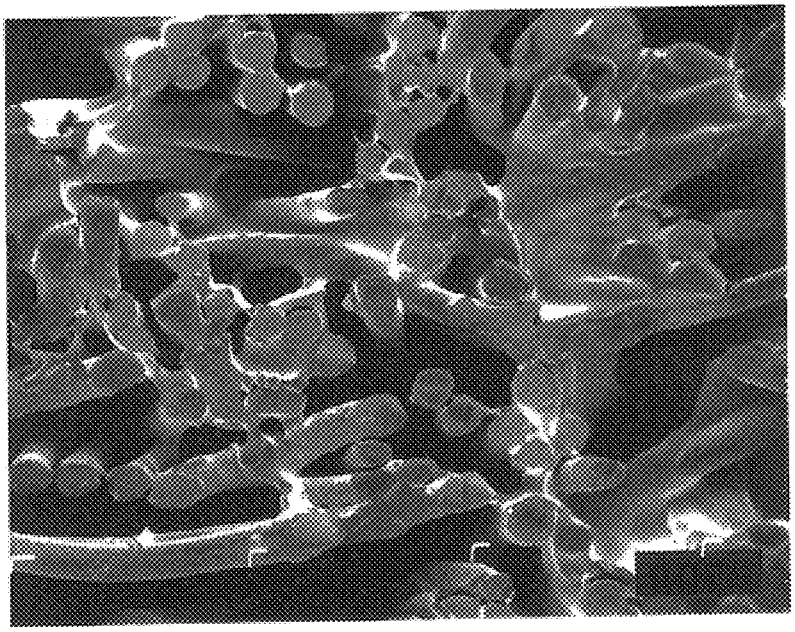
FIG. 1 is an electron micrograph taken of a cross-section of a conventional leather-like sheet of prior art obtained by impregnating a fibrous substrate with a resin emulsion followed by coagulation.

Fibrous Substrate (I) used in this invention may be any fibrous substrate with an adequate thickness and fulfillment feeling having soft hand touch, and is pretreated with a fiber treating agent which inhibits adhesion of fibers with polyurethane.

Nonwoven fabric, woven and knit fabrics, and the like which have heretofore been used for making artificial leather-like sheet may be employed for making Fibrous Substrate (I).

Among a wide variety of fibrous substrates used, preferably used is a fibrous substrate made only of nonwoven fabric, or a composite structure made of a nonwoven fabric and a woven and/or knit fabric wherein said nonwoven fabric has a nonwoven layer at least on one side of the fabric (for example, a two layer structure consisting of a nonwoven fabric and a woven/knit fabric, a three layer structure consisting of nonwoven fabric layers on both surfaces and a woven knit fabric layer put therebetween).

More preferably used is a fibrous substrate made only of nonwoven fabric. Among a wide variety of nonwoven fabrics used, an entangled nonwoven fabric and lap type nonwoven fabric are preferred. More preferably used is the entangled nonwoven fabric.

Fibers used in the Fibrous Substrate (I) maybe: synthetic fibers, such as polyester fibers, polyamide fibers, acrylic fibers, polyolefine fibers, polyvinyl chloride fibers, polyvinylidene chloride fibers, and polyvinyl alcohol fibers; semi-synthetic fibers; and natural fibers, such as cotton, wool, and hemp.

The fibers employed in Fibrous Substrate (I) mentioned above may be selected from the following types, such as ordinary fibers which do not shrink or stretch, shrinkable fibers, spontaneously stretchable fibers, various composite fibers, various mixed spun fibers, (for examples, multi-layer laminated composite fibers and mixed spun fibers), microfine fibers and their bundled fibers, and special porous fibers.

Denier size of fibers used in Fibrous Substrate(I) may be selected according to the application of the leather-like sheet without specific limitation. Generally, denier size within the range of 0.01 to 10 is preferably used. More preferably used is the range of 0.02 to 8 denier.

Thickness of Fibrous Substrate (I) may vary depending upon the applications. It is generally selected from the range of 0.3 to 3.0 mm from the requirement for adequate hand touch. The range of 0.8 to 2.5 mm is more preferred.

Apparent density of Fibrous Substrate (I) prior to the treatment with a fiber treatment agent is preferably within the range of 0.1 to 0.5 g/cm$^3$ for the sheet to have soft hand, and desirable firmness and resiliency. It is more preferably within the ranges of 0.15 to 0.45 g/cm$^3$. When the apparent density of fibrous substrate is less than 0.1 g/cm$^3$, the firmness and resiliency of the resulting leather-like sheet becomes inferior and would not give a desirable hand and texture of natural leather. On the other hand, if it exceeds 0.5 g/cm$^3$, the resulting sheet will lose firmness and exhibit hand touch of rubbery material.

In manufacturing Fibrous Substrate (I), preferably used nonwoven fabric is the one having a density of 0.25 to 0.50 g/cm$^3$ and comprising at least partially a shrinkable type polyethylene terephthalate. When such substrate is used, the resulting sheet exhibits excellent flexibility and firmness. The polyethylene terephthalate fibers herein used is preferably the one having a shrinkage percentage of 10 to 60% in warm water at 70° C.

Nonwoven fabric mentioned above having a density of 0.25 to 0.50 g/cm$^3$ can be obtained by using a mixture of conventional polyester fibers as those disclosed in Japanese Kokai (laid open) Publication Sho 56-37353 and Japanese Kokai (laid open) Publication Sho 53-53388 with spontaneously stretchable fibers at a certain ratio. The mixed fibers are subjected to shrink in warm water, and to spontaneously stretch by dry heating.

In this invention it is required to pretreat the fibrous substrate with a fiber treatment agent which can inhibit adhesion between the fibers and polyurethane.

When Fibrous Substrate (I) is pretreated with said fiber treatment agent, and impregnated with polyurethane emulsion (I) followed by coagulation, a natural leather-like sheet having a softness and fulfillment feeling not obtainable with the conventional artificial leather-like sheet can be obtained.

A preferred fiber treatment agent herein used can be a silicone type water repellent softening agent, such as dimethyl silicone oil (oily dimethyl polysiloxane), methylphenyl silicone oil (oily methylphenyl polysiloxane), methylhydrogen silicone oil (oily methylhydrogen polysiloxane, polysiloxane having a oily methylhydrogen siloxy unit and dimethysiloxy unit, or a mixture thereof), diorganopolysiloxane diol, fluorosilicone oil, silicone-polyether copolymer, alkyl modified silicone oil, higher fatty acid modified silicone oil, amino-modified silicone oil, and epoxy modified silicone oil. One or more of the above modifying agents can be used.

Among the silicone type water repellent softening agent, a mixture of dimethyl silicone oil (oily dimethyl polysiloxane) and methylhydrogen silicone oil (oily methylhydrogen polysiloxane, polysiloxane having oily methylhydrogen siloxane unit and dimethyl siloxane unit, and a mixture thereof) is preferably used due to its availability and its excellent properties in giving softness and water repellency to the fibrous substrate.

Among the silicone oils mentioned above, as the number of Si—H bonds increases, water repellency increases, and the baking temperature can be lowered. For this reason, when polysiloxane having methylhydrogen siloxy unit and dimethyl siloxy unit is used for methylhydrogen silicone oil to mix with dimethyl silicone oil, the ratio of methylhydrogen siloxy unit is preferably at least 60 mol. %. The weight ratio of dimethyl silcone oil:methyhydrogen silicone oil is preferably in the range of 1:9 to 9:1. If the content by weight of dimethyl silicone oil (dimethyl polysiloxane) is less than 10 wt. %, the leather-like sheet obtained tends to give harder hand touch. On the other hand, if the content by weight of methylhydrogen silicone oil is less than 10 wt. %, water repellency of the resulting leather-like sheet becomes insufficient.

Among the silicone type water repellent softening agents, there are available oil type, emulsion type and solution type. Although any of the above types can be used in this invention, an emulsion of oil in water type is more preferably used in industrial production.

For the purpose of providing high repellency to the fibrous substrate at a relatively low temperature, the silicone type water repellent softening agent may be incorporated with a metal salt of an organic acid as the catalyst, such as tin, titanium, zirconium, and zinc salts of organic acids.

The fiber treatment agent described above can be added in many different ways as long as it can be uniformly added to the fibrous substrate. For example, the fiber treatment agent is diluted with water to 0.5–5 wt. % aqueous solution and then catalyst is added at need to the solution to give a treatment solution. The fibrous substrate is then immersed into the treatment solution. The substrate is then taken out from the solution, pressed to adjust the amount of the treatment agent attached to the substrate. The substrate may be subjected to predrying if necessary, and then dried by heating. To ensure firm bonding of the treatment agent onto the substrate, a drying temperature in the range of 50 to 100° C. is preferred.

The amount of the treatment agent attached to the substrate (after heat dried) is preferably in the range of 0.05 to 5 wt. % based on the weight of the substrate. More preferably it is in the range of 0.3 to 3 wt. %. If the amount of the treatment agent is less than 0.05 wt. %, the leather-like sheet thus obtained lacks in softness and water repellency. On the other hand, if the amount exceeds 5 wt. %, the treatment agent bleeds out to the surface of the sheet, thereby causing likelihood of deterioration of hand touch of the surface and appearance, and adhesion of the repellent softening agent to other objects.

Fibrous Substrate (I) maybe pretreated at need with urea resins, melamine resins, ethylene urea resins, and glyoxal resins to enhance laundry resistence of leather-like sheet material.

Fibrous Substrate (II) in the present invention can be any fibrous substrate made of microfine fibers with soft hand touch, and have an adequate thickness and fulfillment feeling. Various fibrous substrates conventionally usable in making leather-like sheets can be used as well. Preferably usable microfine fibers have denier size of at most 0.5 denier in Fibrous Substrate (II). More preferably used microfine fibers have s size of at most 0.4 denier and more than 0.001 denier.

In this invention Fibrous Substrate (II) composed of microfine fiber-forming fibers is impregnated with polyurethane emulsion (II), and then coagulated. After the coagulation step the microfine fiber-forming fibers are converted to microfine fibers, which are then used to make a leather-like sheet. In this way, the impregnation of polyurethane emulsion into the substrate (II) becomes easier and the leather-like sheet thus obtained exhibits softness and fulfillment feeling as well as excellent hand touch similar to those of natural leather.

As for microfine fiber-forming fibers, either composite spun fibers or mixed spun fibers comprising at lease two kinds of polymeric materials are preferably used. A portion of polymeric material in the mixed spun fibers or composite spun fibers is removed by dissolving it and/or decomposing it leaving microfine fibers.

Examples of such polymeric materials are sea-island type composite spun fibers and sea-island type mixed spun fibers. The polymer constituting sea component in such fibers is dissolved away with an organic solvent thus leaving the island component to form microfine fibers. Fibrous Substrate (II) used in this invention can be either sea-island type composite spun fibers or sea-island type mixed spun fibers, or a mixture of the two.

A wide variety of polymeric materials may be suitable for making sea-island type composite spun fibers and sea-island type mixed spun fibers used in this invention. Some of the examples are polyesters such as polyethylene telephthalates, polybutylene telephthalates, and modified polyesters, polyamides such as nylon-6, nylon-6, 12, nylon-6, 6, and modified nylons, polyolefins such as polyethylenes, polypropylenes, polystyrenes, polyvinylidene chlorides, polyvinyl acetates, polymethacrylates, polyvinyl alcohols, and polyurethane elastomers.

By selecting a combination of at least two polymers from the examples given above as a sea component and an island component which have different solubility in an organic solvent, the sea component can be dissolved away with an organic solvent to leave the island component intact as microfine fibers. In this way, microfine fiber-forming fibers for sea-island type composite spun fibers and sea-island type mixed spun fibers can be obtained. The island component may be composed of one type of polymer or a plurality of polymers. When a plurality of polymers are used in the island component, the resulting fibrous substrate contains a plurality of microfine fibers.

The ratio of island component: sea component is not specifically limited. Generally, however, from the viewpoints of ease in production of composite spun fibers and mixed spun fibers, ease in forming microfibers, and physical properties of resulting leather-like sheet, the ratio (island component:sea component) is preferably 15:85 to 85:15, more preferably 25:75 to 75:25.

The number and size of island components, and how island components are dispersed in the sea component may be varied broadly without any restriction as long as fibrous substrate of microfine fibers can be easily obtained from the microfine fiber-forming sea-island type composite spun fibers and sea-island type mixed spun fibers.

Preferable Fibrous Substrate (II) is made from sea-island type composite spun fibers and/or sea-island type mixed spun fibers using polyethylene and/or polystyrene as the sea component and polyethylene terephthalate and/or polyamide as the island component. The Fibrous Substrate thus prepared is then impregnated with polyurethane emulsion followed by coagulation. Polyethylene and/or polystyrene in the sea-component is then dissolved away with an aromatic solvent such as benzene, toluene, and xylene, or a halogenated hydrocarbon such as carbon tetrachloride and perclene. Particularly when toluene is used to dissove the sea component leaving polyethylene terephthalate and/or polyamide as the island component, the leather-like sheet obtained exhibits excellent softness and fulfillment feeling with natural leather-like hand touchness, suitable for use as an artificial leather material.

The Fibrous Substrate (II) used in this invention may be based on nonwoven fabric and/or woven knit fabric. Preferably used are nonwoven fabric only or a composite structure consisting of nonwoven fabric having a nonwoven layer on at least one side of the surface, and woven fabric and/or knit fabric (for example, two-layer structure of nonwoven layer and woven knit layer, three-layer structure consisting of nonwoven layer on both the sides of the surface and woven knit fabric therebetween). Preferably used nonwoven fabrics are entangled nonwoven fabric and lap type nonwoven fabric. The entangled nonwoven fabric is the most preferred among them.

Fibrous Substrate (II) may be made from the microfine fiber-forming fibers mentioned above in combination with an other fibrous material if necessary as long as leather-like hand touch is not impaired. Examples of other fibrous materials used for the above purpose includes ordinary fibers, shrinkable fibers, spontaneously stretchable fibers, multi-layer laminated composite fibers, and porous fibers. The above fibers may be used alone or in combination.

These fibers may be synthetic fibers such as polyester fibers, polyamide fibers, acrylic fibers, polyolefin fibers, polyvinyl chloride fibers, polyvinylidene chloride fibers, polyvinyl alcohol fibers, semi-synthetic fibers, and natural fibers such as cotton, wool and hemp.

Thickness of Fibrous Substrate (II) may vary according to the applications of leather-like sheets. In general, thickness of 0.3 to 3.0 mm before the substrate is impregnated with Polyurethane Emulsion (II) is preferably used for adequate hand touch. More preferably the thickness of 0.8 to 2.5 mm is used.

In order to obtain a natural leather-like sheet of soft hand touch, apparent density of Fibrous Substrate (II) is preferably in the range of 0.05 to 0.8 g/ $cm^3$ when measured after the fibers in the firous substrate are converted to microfine fibers (after the sea component is removed from the sea-island type composite spun fibers and mixed spun fibers leaving microfine fibers mentioned above). The range of 0.1 to 0.5 g/$cm^3$ is more preferred.

If the apparent density of the fibrous substrate is less than 0.05 g/$cm^3$, the leather-like sheet thus obtained shows poor resiliency and firmness lacking hand touch of natural leather.

On the other hand, if the apparent density exceeds 0.8 g/$cm^3$, the leather-like sheet obtained shows no firmness giving a rubbery hand touch.

In this invention the above Fibrous Substrate (II) is impregnated with Polyurethane Emulsion (II) and coagulated. To facilitate smooth and uniform impregnation of Polyurethane Emulsion (II) the fibrous substrate may be pretreated with a surfactant of penetrant type as required. Particularly when Fibrous Substrate (II) is made from sea-island type composite spun fibers or sea-island type mixed spun fibers composed of a non-polar type polyolefin or polystyrene as the sea component, pretreatment with the surfactant mentioned above is quite effective in improving impregnation of polyurethane emulsion.

Among the surfactants having the penetrating and wetting characteristics, wetting agents, penetrating agents, leveling agents are widely known type of surfactants in the industry.

Examples of such surfactants include sulfonate salt type anionic surfactants such as di-2-ethylhexyl sulfosuccinate sodium salt, di-octyl sulfosuccinate sodium salt, and sodium dodecylbenzenesulfonate, sulfate ester type anionic surfactants such as sodium lauryl sulfate, sodium butyl oleate sulfate and sodium dibutylnaphthalene sulfate, polyethylene glycol type nonionic surfactants of having an HLB value of 6 to 16 such as polyethylene glycol-mono-4-nonylphenyl ether, polyethylene glycol monooctyl ether, polyethylene glycol monodecyl ether, fluorine-type surfactants and silicone-type surfactants. These surfactants may be used alone or in combinations of at least two surfactants.

An alcohol may be used in combination with the above surfactants to enhance penetration of polyurethane into fibrous substrate. An alcohol in which the molecular weight per hydroxyl group is at most 200 is preferably used. Examples of the alcohols suitable for this purpose are mono-ols such as methanol, ethanol, propanol, butanol, pentanol, hexanol, heptanol, octanol, and butylcarbitol, diols such as ethyleneglycol, propanediol, and butanediol, and triols such as trimethypropanetriol. If the molecular weight per hydroxyl group exceeds 200, enhancement in penetration by the addition of the alcohol can hardly be expected.

When surfactants and alcohols are used as penetrants, it is advisable to be added to Fibrous Substrate (II) in the form of aqueous solution or aqueous dispersion.

The amount of surfactant and alcohol added to Fibrous Substrate (II) is preferably in the range of 0.01 to 20 wt. %, and 0.001 to 5 wt. %, respectively, on the basis of the substrate.

The total amount of the surfactant and the alcohol added to the substrate is preferably in the range of 1 to 50 wt. %, more preferably in the range of 1 to 30 wt. %.

When the surfactant and the alcohol are added to Fibrous Substrate (II) prior to the impregnation with polyurethane, it is preferable to add the polyurethane emulsion to the substrate wetted with the surfactant and the alcohol without drying. If the substrate is dried before it is impregnated with polyurethane emulsion, enhancement of penetration of polyurethane due to the addition of the surfactant and alcohol may not be observed.

As previously defined, polyurethane emulsions (I) and (II) used in this invention must be heat gellable. "Heat gellable polyurethane emulsion" herein defined means those emulsions which upon heating lose fluidity to become gel.

In this invention heat gellable polyurethane emulsion (I) and (II) are generally those emulsions which gel at temperatures of from 35 to 90° C., more preferably from 40 to 80° C. If the polyurethane emulsion used is not heat gellable type, emulsion particles during heat drying of the impregnated polyurethane emulsion may migrate in the fibrous substrate, thus causing non-uniform distribution of polyurethane in the fibrous substrate. This will result in formation of inferior leather-like sheet lacking in such physical properties as strength, elongation and softness with poor hand touch.

When the impregnated emulsion is gelled in water at an elevated temperature, the emulsion may disperse to water from the fibrous substrate if the emulsion is not heat gellable type, thus causing non-uniform distribution of the polyurethane in the substrate. Again, this will result in formation of poor leather-like sheet lacking in such physical properties as strength, elongation and softness, as well as deterioration of hand touch and feel.

As a heat gellable polyurethane, any of a polyurethane emulsion which itself is heat gellable type and a polyurethane emulsion which contains a heat gelling agent can be used.

Heat gelling agents which can be used for gelling polyurethane emulsions are exemplified by inorganic salts, nonionic type polyethylene glycol surfactants, polyvinyl methylethers, polypropylene glycols, silicone polyether copolymers and polysiloxanes. The above material can be used alone, or in combination.

Among those exemplified above, a combination of inorganic salts and nonionic polyethylene glycol surfactants is preferred as the gelling agent for polyurethane emulsions. Preferably used inorganic salts are mono-valent and di-valent metal salts which can lower the clouding point of polyethylene glycol type nonionic surfactants. Examples of such metal salts include sodium carbonate, sodium sulfate, calcium chloride, calcium sulfate, zinc oxide, zinc chloride, magnesium chloride, potassium chloride, potassium carbonate, sodium nitrate, and lead nitrate, These can be used alone or in combination.

Examples of nonionic polyethylene glycol surfactants include ethylene oxide adducts of higher alcohols, ethylene oxide adducts of alkylphenols, ethylene oxide adducts of fatty acid, ethylene oxide adducts of polyhydric alcohol aliphatic esters, ethylene oxide adducts of higher alkylamines, and ethylene oxide adducts of polypropylene glycols. These can be used alone or in combination.

When heat gelling agent is used in the polyurethane emulsion, preferably used amount ranges from 0.2 to 20 parts by weight per 100 parts by weight of resin in the emulsion.

As defined previously in the condition (ii), Polyurethane Emulsions (I) and (II) are required to form a film with 100 $\mu$m upon drying at 50° C. having a modulus of elasticity of $2.0\times10^7$ to $5.0\times10^8$ dyn/cm$^2$ at 90° C. If a polyurethane emulsion which gives the modulus of elasticity of less than $2.0\times10^7$ dyn/cm$^2$ at 90° C. is used, fibers in the fibrous substrate are held tightly together by polyurethane when polyurethane emulsion is impregnated and gelled, and gives the resulting sheet lacking in fulfillment feeling with hand touch similar to natural leather.

If a polyurethane emulsion which gives the modulus of elasticity higher than $5.0\times10^8$ dyn/cm$^2$ at 90° C. is used, the resulting sheet shows poor and hard hand touch lacking in softness.

Another preferable requirement for Polyurethane Emulsion (I) used in this invention is $\alpha$ dispersion temperature (T$\alpha$) of the film of 100 $\mu$m thickness obtained by drying Polyurethane Emulsion (I) at 50° C. Said $\alpha$ dispersion temperature is preferably lower than −10° C., more preferably lower than −20° C. and higher than −100° C. If Polyurethane Emulsion (I) satisfies this requirement, leather-like sheet obtained will have excellent physical properties such as bending fatigue resistance.

As defined previously in the condition (iii), Polyurethane Emulsion (II) used in this invention needs to form a film, when dried at 50° C., having a modulus of elasticity of more than $1.0\times10^7$ dyn/cm$^2$ and preferably less than $5.0\times10^8$ dyn/cm$^2$ at 160° C. at a thicknes of 100 $\mu$m. If the modulus of elasticity is less than $1.0\times10^7$ dyn/cm$^2$, the resulting sheet has a small thickness as well as inferior softness, fulfillment feeling and firmness during squeezing operation with a squeezing roller in microfine fiber formation step after polyurethane coagulation step.

The test method used to measure the modulus of elasticity of dried film at 160° C. will be described later in Examples.

Another condition to be met by Polyurethane Emulsion (II) in this invention is $\alpha$ dispersion temperature (T$\alpha$) of the film obtained by drying said Polyurethane Emulsion (II) at 50° C. being lower than −30° C. preferably higher than −100° C. This condition as previously defined in (iv) is important in giving desired softness, fulfillment feeling, and bending fatigue resistance to the resulting leather-like sheet.

If a polyurethane emulsion which gives $\alpha$ dispersion temperature of higher than −30° C. is used, resulting leather-like sheet shows inferior mechanical properties such as bending fatigue resistance, losing durability and giving harder hand touch at around room temperature.

The test method used in this invention to measure α dispersion temperature (Tα) is described in Examples.

Polyurethane Emulsions (I) and (II) used in this invention may be oil-in-water type (O/W type), or water in oil type (W/O type). They may contain an organic solvent, or may totally be aqueous system without containing any organic solvent. However, aqueous emulsion without containing any organic solvent is preferred from the view points of environmental concern due to solvent emission, and dispensing with a solvent recovery step in the production process.

Polyurethanes that are contained in polyurethane Emulsion (I) or (II) used in this invention may be either the polyurethane which forms a heat gellable type polyurethane emulsion by itself even without adding a heat gelling agent, or the polyurethane which is turned into a heat gellable type polyurethane emulsion by the addition of a heat gelling agent, provided that each of said polyurethanes forms a polyurethane emulsion capable of being made into a film having the specific physical properties as described hereinbefore.

Polyurethane (I) and (II) used in this invention may be manufactured by reacting high molecular weight polyols, organic diisocyanates and chain-extenders.

Examples of high molecular weight polyols include polyester polyols, polyether polyols, polycarbonate polyols, and polyester polycarbonate polyols. Polyurethane can be formed using one of the polyols above, or a mixture of at least two polyols shown above.

Polyester polyols used in making the polyurethanes can be manufactured by a conventional process, for example, in which polycarboxylic acid component such as polycarboxylic acid, its ester and ester forming derivatives such as anhydride and polyol component is subjected to direct esterification or to transesterification. An alternative method which can be used for the preparation of polyester polyols is ring opening polymerization of lactone.

Examples of polycarboxylic acids used for making polyester polyols include generally used aliphtic dicarboxylic acids having 4–12 carbon atoms such as succinic acid, glutaric acid, adipic acid, pimelic acid, suberic acid, azelaic acid, sebacic acid, dodecanedioic acid, methylsuccinic acid, 2-methyglutaric acid, 3-methyglutaric acid, trimethyladipic acid, 2-methyloctanedioic acid, 3,8-dimethyldecanedioic acid, and 3,7-dimethydecanedioic acid; alicyclic dicarboxylic acids such as cyclohexane dicarboxylic acid; aromatic dicarboxylic acid such as terephthalic acid, isophthalic acid, orthophthalic acid,naphthalene dicarboxylic acid; and ester-forming derivatives thereof. Polyester polyols can be made by using one of the polycarboxylic acids listed above, or a combination of two or more of the above acids.

Among those acids listed above, preferably used are aliphatic polycarboxylic acids and their ester-forming derivatives. In some cases, addition of a small amount of polycarboxylic acids having 3 or more carboxylic groups or their ester-forming derivatives is desirable.

Examples of polyol components used in making polyesterpolyols include aliphatic diols having 2 to 15 carbon atoms such as ethylene glycol, diethylene glycol, triethylene glycol, propylene glycol, 1,3-propanediol, 2-methyl-1,3-propanediol, 2,2-diethyl-1,3-propanediol, 1,3-butylene glycol, 1,4-butanediol, 3-methyl-1,5-pentanediol, 1,6-hexanediol, 1,8-octanediol, 1,9-nonanediol, 2,8-dimethyl-1,9-nonanediol, and 1,10-decanediol; alicyclic diols such as 1,4-cyclohexanediol, cyclohexanedimethanol, and dimethylcyclooctanedimethanol; aromatic diols such as 1,4-bis(β-hydroxyethoxy) benzene; polyalkylene glycols; and polyols such as glycerine, trimethylolpropane, butanetriol, and pentaerythritol. These polyols can be used alone or in combination in making polyesterpolyols.

Examples of lactones used in making polyesterpolyols include ε-caprolactone and β-methyl-δ-varelolactone.

Examples of polyetherpolyols used in making polyurethanes include polyethylene glycols, polypropylene glycols, polytetramethylene glycols, and poly (methyltetramethylene) glycol. These glycols can be used alone or in combination.

Examples of polycarbonate polyols used in making polyurethanes include those obtained by the reaction of polyols and carbonates such as dialkylcarbonates and diaryl carbonates. Polyols used for making polycarbonate polyols can be those polyols used in making polyesterpolyols mentioned above. Examples of dialkylcarbonates include dimethylcarbonate and diethylcarbonate. As a diaryl carbonate, diphenyl carbonate can be used.

Examples of polyester polycarbonate polyols include products obtained by the reaction of polyol, polycarboxylic acid and carbonate, and products obtained by the reaction of polyesterpolyol and polycarbonatepolyol prepared in advance with carbonate compound.

High molecular weight polyols preferably used for making polyurethanes in this invention are those having a number-average molecular weight of 500 to 5000, and more preferably 600 to 3000. The number average molecular weight used in this invention is calculated based on the hydroxyl value measured in accordance with the specification in JIS K 1577.

The number of hydroxy groups per molecule of the high molecular weight polyols used in preparing polyurethanes may be more than 2 as long as it does not hamper production of polyurethane emulsion. Polyols, for example, polyesterpolyols having at least two hydroxyl groups in one molecule can be made by incorporating polyols such as glicerine, trimethylol propane, butanetriol, hexanetriol, trimethylolbutane, and pentaerythritol in the polyol component in making said high molecular weight polyols.

Organic diisocyanates used in making Polyurethane Emulsion (I) and (II) may be selected from aliphatic diisocyanates, alicyclic diiscyanates, and aromatic diisocyanates which have been widely known and conventionally used to make polyurethane emulsions. Examples of diisocyanates which may be used include isophorone diisocyanate, tolylene diisocyanate, 4,4-diphenylmethane diisocyanate, p-phenylene diisocyanate, 1,5-naphthalene diisocyanate, xylilene diisocyanate, hexamethylene diisocyanate, 4,4'-dicyclohexylmethane diisocyanate, 3,3'-dichloro-4,4'-diphenylmethane diisocyanate, and hydrogenated xylilene diisocyanate. These organic diisocyanates can be used alone or in combination.

Organic diisocyanates used in making Polyurethane Emulsion (II) are selected preferably from aromatic diisocyanates such as tolylene diisocyanate and 4,4'-diphenylmethane diisocyanate because the resulting polyurethanes obtained from such diisocyanates are excellent in solvent resistance. Because of the higher solvent resistance, polyurethane in the fibrous substrate during the microfine fiber formation step is less damaged by an organic solvent used to remove sea-components in the sea-island type composite or mixed spun fibers when Polyurethane Emulsion (II) is made of aromatic diisocyanates, thus being protected from deterioration in physical properties. This makes it possible to provide a leather-like sheet having excellent mechanical properties and hand touch.

The chain extender used in making Polyurethane Emulsion (I) and (II) can be any agents which have been conventionally used in making polyurethane. Among those conventionally used, low molecular weight compounds having at least 2 active hydrogens in the molecule with a molecular weight of less than 400 are preferably used. Among a wide variety of compounds available, preferably used are diols such as ethylene glycol, propylene glycol, 1,4-butanediol, 1,6- hexanediol, 3-methyl-1,5-pentanediol, neopentyl glycol, 1,4-cyclohexanediol, bis-(β-hydroxyethyl) terephthalate, xylilene glycol, and 1, 4-bis (β-hydroxyethoxy) benzene; diamines such as hydrazine, ethylene diamine, propylene diamine, isophorone diamine, piperazine and its derivatives, phenylene diamine, tolylene diamine, xylylene diamine, adipic acid dihydrazide, isophthalic acid dihydrazide, hexamethylene diamine, 4,4'-diaminodiphenylmethane, and 4,4'-dicyclohexylmethane diamine; triamines such as diethylene triamine; and aminoalcohols such as aminoethylalcohol, and aminopropylalcohol. More preferably used are ethylene glycol, isophorone diamine, ethylene diamine, and diethylenetriamine.

In the preparation of polyurethane, it is desirable to run reaction of high molecular weight polyol, organic diisocyanate, and chain extender so as to maintain the ratio of [Total number of isocyanate groups]/[Total number of functional groups which react with isocyanate such as hydroxyl and amino groups] to be in the range of 0.9 to 1.1 to obtain a leather-like sheet of high tear strength. To improve solvent resistance, heat resistance and hot water resistance of polyurethane, multifunctional polyols and multifunctional amines (at least trifunctional) such as trimethylolpropane may be reacted to impart cross-linking structure to the polyurethane.

Polyurethane Emulsion (I) and (II) used in this invention can be manufactured with the same method as used to make conventional polyurethane emulsions. For example, (1) Liquid polyurethane polymer is emulsified in water under a high mechanical shear in the presence of an emulsifying agent to obtain a nonionic type polyurethane emulsion; (2) A urethane prepolymer having isocyanate group at the end of the chain is made. The prepolymer thus prepared is emulsified in water under a high mechanical shear in the presence of an emulsifying agent, and is subjected to chain extending reaction with a chain extender to give an nonionic high molecular weight polyurethane emulsion; (3) A self-emulsifiable polyurethane is made of a hydrophilic high molecular weight polyol, and then emulsified to form a polyurethane emulsion without using an emulsifier.

Examples of emulsifying agents used in the method (1) and (2) described above include nonionic surfactants such as polyoxyethylene nonylphenyl ether, polyoxyethylene octylphenyl ether, polyoxyethylene lauryl ether, polyoxyethylene stearyl ether, and polyoxyethylene-polyoxypropylene block copolymer; anionic surfactants such as sodium lauryl sulfate, ammonium lauryl sulfate, sodium dodecylbenzene sulfonate, sodium alkyldiphenylether sulfonate, and sodium di(2-ethylhexyl) succinate sulfonate. More preferably used are nonionic surfactants having an HLB of 6 to 20.

Hydrophilic high molecular weight polyols used in (3) can be made by adding active hydrogen containing compounds having hydrophilic groups to the raw materials for making high molecular weight polyols. The active hydrogen atom containing compounds having hydrophilic groups are those having at least one active hydrogen atom such as hydroxyl group or amino group in the molecule and having at least one hydrophilic group selected from the group comprising anionic groups such as carboxylic acid, sulfonic acid, carbonate, and sulfonate; nonionic groups such as polyoxyethylene group; and cationic group such as tertiary amino group and quaternary ammonium group. Examples of such compounds include carboxylic group-containing compounds and their derivatives such as 2,2-dimethylolpropionic acid, 2,2-dimethylolbutyric acid, and 2,2-dimethylolvarelic acid; sulfonic acid group-containing compounds such as 1,3-phenylenediamine-4,6-disulfonic acid, and 2,4-diaminotoluene-5-sulfonic acid; nonionic group-containing compounds such as polyoxyethylene glycols having molecular weight of 200–10,000 and their derivatives; tertiary amino group-containing compounds such as 3-dimethylaminopropanol and their derivatives.

In the method (3) described above, 2,2-dimethylolpropionic acid is preferably used as a hydrophilic group-containing compound, and added to the raw materials for high molecular weight polyols. The resulting high molecular polylol is then reacted with an organic diisocyanate compound to give a polyurethane prepolymer. The resulting prepolymer is then reacted with a basic material such as triethylamine, trimethylamine, sodium hydroxide, and potassium hydroxide to form a corresponding carboxylate salt giving a polyurethane emulsion.

Polyurethane Emulsion (I) and (II) used in this invention may be made by using one or more of the methods described in (1) to (3), and emulsified with a homomixer or a homogenizer. In order to suppress the reaction of isocyante with water, the emulsification is made preferably at a temperature below 40° C., more preferably below 30° C. and over 0° C.

Polyurethane Emulsion (I) and (II) used in this invention may contain other polymers if desired as long as the addition of such polymer does not impair the properties of the leather-like sheet obtained. Elastic synthetic polymers as listed below are examples of such polymers. Synthetic rubbers such as acrylonitrile-butadiene coplymers, polybutadienes, and polyisoprenes, ethylene-propylene copolymers, polyacrylates, acrylic copolymers, silicones, other polyurethanes, polyvinyl acetates, polyvinyl chlorides, polyester-polyether block copolymers, and ethylene-vinylacetate copolymers. Polyurethane Emusion (I) and (II) may contain one or more of the above polymers.

Polyurethane Emulsion (I) and (II) may contain, if desired, additives widely known to those skilled in the art, such as antioxidants, anti-light stabilizers, UV absorbers, surfactants such as penetrants, thickeners, biocides, water soluble polymers such as polyvinyl alcohols and carboxymethylcellulose, dyes, pigments, fillers, and coagulation regulators. These additives may be used alone or in combination.

Any methods can be used to impregnate Polyurethane Emulsion (I) and (II) into Fibrous Substrate (I) and (II) as long as the polyurethane emulsion can be uniformly impregnated into the substrate. Generally, fibrous substrate is immersed into the polyurethane emulsion or sprayed with the emulsion. After the emulsion is impregnated into the fibrous substrate, a press roll or a doctor knife is applied to adjust the amount of polyurethane emusion added to the substrate.

After the impregnation step, the polyurethane emulsion impregnated into the fibrous substrate is coagulated by applying heat. Methods useful to thermally coagulate the polyurethane emulsions include:

(1) a method in which a fibrous substrate impregnated with the polyurethane emulsion is immersed into warm water at 70 to 100° C.;

(2) a method in which heated steam at 100 to 200° C. is sprayed onto a fibrous substrate impregnated with the polyurethane emulsion; and (3) a method in which a fibrous substrate impregnated with the polyurethane emulsion is placed in a drying apparatus at 50 to 150° C. and subjected to drying under heat to coagulate.

The methods (1) and (2) described above are more preferably used since these methods can provide a leather-like sheet of softer hand touch. After the coagulation methods (1) and (2) are used, further drying by heat or air is made to remove moisture contained in the leather-like sheet.

The amount of the polyurethane contained in leather-like sheet after Fibrous Substrate (I) or (II) are impregnated with Polyurethane Emulsion (I) or (II) followed by coagulation and drying (when the polyurethane emulsion contains other polymers, the amount includes those of such other polymers) is preferably in the range of 5 to 150 wt. % based on the weight of Fibrous Substrate (I) or Fibrous Substrate (II) after microfine fibers are formed, more preferably 10 to 100 wt. %, and most preferably 20 to 80 wt. %. If the amount of polyurethane is less than 5 wt. %, the resulting leather-like sheet lacks in fulfillment feeling and hand touch desirable for natural leather. On the other hand, if the amount exceeds 150 wt. %, the resulting leather-like sheet exhibits harder hand touch, again lacking desired hand touch of natural leather.

When Fibrous Substrate (II) is used as a substrate, microfine fiber-forming fibers in Fibrous Substrate (II) need to be subjected to a treatment required for microfine fiber formation. When the Fibrous Substrate (II) is made of sea-island type composite spun fibers and/or sea-island type mixed spun fibers, after the steps of polyurethane impregnation, coagulation and drying, the sea component needs to be dissolved away leaving the island component remaining as microfine fibers. The process for removing the sea component can be any process already known in the industry widely used in making synthetic leather-like sheets and the like.

Figure 2:
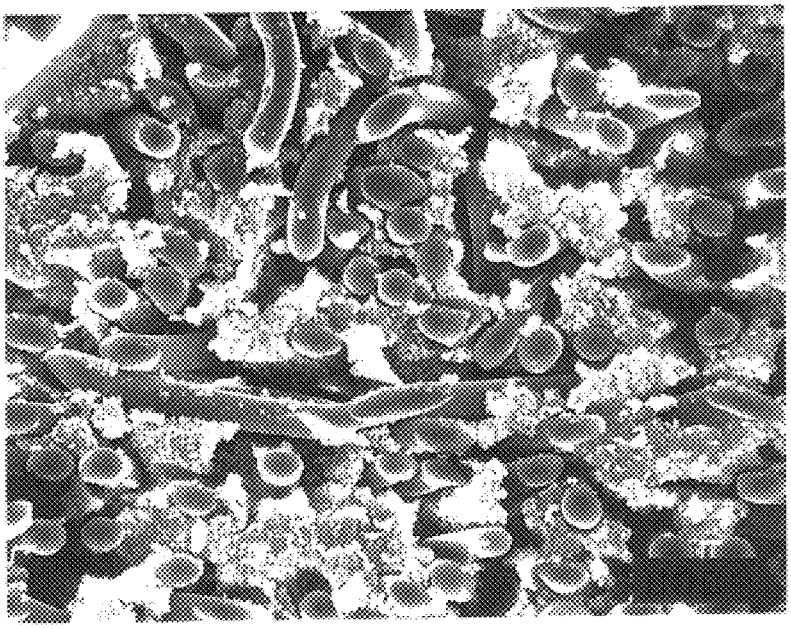
FIG. 2 is an electron micrograph taken of a cross-section of a leather-like sheet obtained in Example 1 according to the present invention.

The leather-like sheets thus obtained as described above exhibit both softness and fulfillment feeling with a desirable natural leather-like hand touch, sufficiently comparable to the synthetic leather obtainable with the wet coagulation process. As shown in FIG. 2 which is an electron micrograph (an electron micrograph of the cross section of the leather-like sheet obtained in Example 1) of a cross-section of a leather-like sheet obtained from Fibrous Substrate (I) and Polyurethane Emulsion (I), it is evident that the polyurethane is coagulated as particles connected together without binding fibers in the fibrous substrate.

Figure 4:
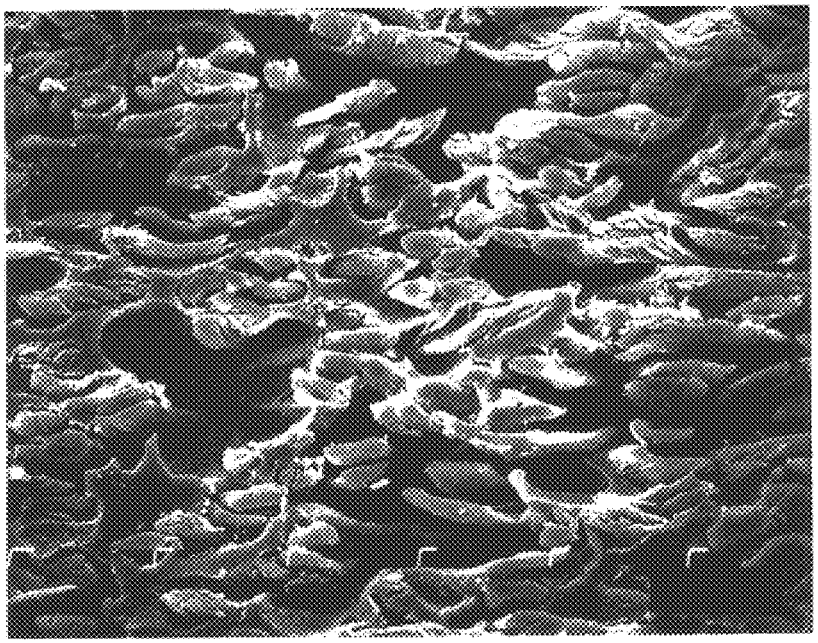
FIG. 4 is an electron micrograph taken of a cross-section of a leather-like sheet obtained in Example 4 according to the present invention.

As is evident from FIG. 4 which is an electron micrograph of a cross-section of a leather-like sheet obtained from Fibrous Substrate (II) and Polyurethane Emulsion (II), the polyurethane is seen to fill the open space among microfine fibers and yet it is not binding microfine fibers tightly in the fibrous substrate leaving adequate space among the mirofine fibers. Therefore, the loss of flexibility and flattening of the sheet caused by fibers being bound tightly together is not seen in the sheet obtainable with this invention, thereby giving a resulting leather-like sheet having hand touch with satisfactory softness and fulfillment feeling similar to the natural leather.

Accordingly, the sheets obtainable with this invention are suited to a wide variety of applications taking advantage of superior characteristics as mentioned above, such as mattresses, lining materials for shoes, interlining cloths for clothings, cushion materials, upholsteries for automobiles, railcars, and aircrafts, wall coverings, carpets and the like. Furthermore, if the surface of sheet is buffed, suede-like artificial leather can be obtained, which are quite useful for applications such as clothings, upholsteries for furnitures, automobiles, and railcars, wall coverings, and gloves. If the leather-like sheets obtained in this invention is covered with a polyurethane layer by the methods commonly used in the industry, grain leather-like sheets can be obtained, which are useful for applications such as sports shoes, men's shoes, bags, handbags, and satchels.

EXAMPLES

Hereinafter typical embodiments of the present invention are explained referring to specific working examples, but it should be understood that the invention is in no sense limited to these examples.

In Examples and Comparative Examples, heat gelling temperature, modulus of elasticity and α dispersion temperature (Tα) of the polyurethane film of 100 μm thickness, flexibility (flexural rigidity), bending fatigue resistance, and hand touch of leather-like sheet were measured in the following manner.

(1) Heat gelling temperature of polyurethane emulsions:

10 grams of a polyurethane emulsion was measured in a test tube. The test tube was then dipped in a hot water bath maintained at a constant temperature of 90° C. While stirring, the temperature of the bath was raised. The temperature at which polyurethane emulsion lost fluidity and gelled was recorded as the heat gelling temperature (° C.).

(2) Modulus of Elasticity at 90° C. and 160° C. and a Dispersion Temperature (Tα) of the film obtained from drying polyurethane emulsion:

(i) A polyurethane emulsion was poured onto a glass plate, and placed in a heated air type dryer at 50° C. for 8 hours to obtain a piece of film having 100 μm thickness.

(ii) Using a piece of the film obtained above (i), modulus of elasticity was measured with a rheology tester (FT RHEOSPECTORER DVE-V4 from RHEOLOGY CO., Ltd.) at 11 Hz at 90° C. and 160° C. α Dispersion temperature (Tα) (° C.) was measured from the peak of the wave of a chart obtained for the test piece.

(3) Flexibility of leather-like sheet (Flexural rigidity):

A test piece of 10 cm×10 cm in size was cut from the leather-like sheet obtained in the following Examples and Comparative Examples. Using a flexural rigidity tester ("KES-FB2-L" from KATO TEKKO CO., Ltd.), flexural rigidity ($gfcm^2/cm$) of the sheet was measured in the direction perpendicular to the line direction of the sheet rolled, and used as an indicator for the flexibility of the sheet.

(4) Bending fatigue resistance of leather-like sheet:

A test piece of 7 cm×4.5 cm in size was cut from the leather-like sheet obtained in the following Examples and Comparative Examples. A bending fatigue tester ("Flexometer" from Bally Corp.) was used to test bending fatigue resistance of the test piece at 20° C. according to the specifications of JIS K 6545. At the every 100,000 times bendings, the surface of the leather-like sheet was observed until fissures or holes appeared. If the number of bending times exceeds 500,000 times without fissures or holes, bending fatigue resistance of the test piece was considered as satisfactory and was marked with "O".

(5) Hand and texture of leather-like sheet:

Hand touch of the leather-like sheet obtained in the following Examples and Comparative Examples was measured by actually touching the sheet. Samples giving natural leather-like hand touch were recorded with "O" mark.

Samples lacking in softness and giving harder hand touch, and/or lacking in fulfillment feeling thus being far short of having natural leather quality were considered as unsatisfactory and marked with "X".

Abbreviation and full content thereof of high molecular polyols used in the following examples are as follows.

PMSA1850: Polyester diol having a number-average molecular weight of 1850 (an aliphtic polyester diol obtained by the reaction of 3-methyl-1,5-pentanediol with a mixture of adipic acid and sebacic acid(molar ratio of ⅓).

PHC2000: Polyhexamethylene carbonatediol having a number-average molecular weight of 2000.

REFERENCE EXAMPLE 1

Preparation of a Fibrous Substrate Treated with a Water Repellent Softnening Agent (1) Polyethylene terephthalate fibers (2 denier, 51 mm length, percent shrinkage 25% in hot water of 70° C.) were processed with a card and cross-lapper to give webs of 240 g/m$^2$. These webs were introduced into a needle-locker-room and needle-punched (700 punchs/cm$^2$) followed by immersion into warm water at 70° C. for 2 min. causing to shrink to 56% of the original size in area. The resulting fabric was then pressed at 155° C. with a cylinder-belt press to give a nonwoven fabric having a thickness of 1.2 mm, weight of 360 g/m$^2$ and apparent density of 0.30 g/cm$^3$.

(2) The nonwoven fabric obtained above in (1) was impregnated with an emulsion containing a silicone-based water repellent softening agent (solid content 5 wt. %) comprising dimethyl polysiloxane ("KF96L" from The Shin-Etsu Chemical Co., Ltd.) and methylhydrogen polysiloxane ("KF99" from The Shin-Etsu Chemical Co., Ltd.) at 5:5 weight ratio. The nonwoven fabric was then dried at 130° C. for 30 min. to give a water repellent softening agent-treated nonwoven fabric (1.2 wt. % of silicone-based water repellent softening agent (solid) on the weight of nonwoven fabric), which is hereinafter called Nonwoven Fabric (1).

REFERENCE EXAMPLE 2

Preparation of a Fibrous Substrate without Addition of Water Repellent Softening Agent A nonwoven fabric was prepared with the procedure described in (1) in Reference Example 1 above to give a nonwoven fabric without having a water repellent softening agent (hereinafter called Nonwoven Fabric (2)).

REFERENCE EXAMPLE 3

Preparation of a Fibrous Substrate with a Water Repellent Softening Agent (1) An entangled nonwoven fabric having thickness of 1.4 mm, and apparent density of 0.25 g/cm$^3$ was prepared with a mixture of widely used polyethylene terephthalte fibers (2.5 denier) and nylon fibers (1.5 denier) in 35:65 wt. ratio.

(2) The entangled nonwoven fabric prepared above in (1) was immersed into a 5 wt. % solution of silicone-based water repellent softening agent ("GERANEX SH" from Matsumoto Oil and Fat Pharmaceutical Co., Ltd.), squeezed with a roll , and dried at 130° C. for 30 min. to give a nonwoven fabric with a water repellent softening agent (1.0 wt. % of silicone-based water repellent softening agent (solid) on the weight of nonwoven fabric) (hereinafter called Nonwoven Fabric (3)).

REFERENCE EXAMPLE 4

Fibrous Substrate without a Water Repellent Softening Agent

A nonwoven fabric made in the same way as described in (1) in Reference Example 3 as a fibrous substrate to be used without adding a water repellent softening agent (This nonwoven fabric is hereinafter called Nonwoven Fabric (4)).

REFERENCE EXAMPLE 5

Preparation of a Fibrous Substrate Comprising a Microfine Fiber-forming Fibers (1) Sixty parts by weight of Nylon-6 and 40 parts by weight of polyethylene were mixed and spun, and sujected to drawing and cutting to give a sea-island type mixed spun fibers (4 denier, 51 mm length, 600 islands component fibers in the cross-section), which were then processed with a card, a cross-lapper, and a needle-punch to give an entangled nonwoven fabric of apparent density of 0.160 g/cm$^3$.

(2) The entangled nonwoven fabric obtained above in (1) was heated whereby the sea component (polyethylene) was melted causing fibers held together to form an entangled nonwoven fabric having smooth surfaces on both sides and an apparent density of 0.285 g/cm$^3$ (hereinafter called Nonwoven Fabric (5).

REFERENCE EXAMPLE 6

Preparation of a Fibrous Substrate Comprising a Micofine Fiber-forming Fibers A sea-island type composite spun fibers (4 denier in fineness, 15 island component fibers in the cross-section, 51 mm in length) was prepared from 70 by parts weight of polyethylene terephthalate and 30 parts by weight of low density polyethylene, and converted to an entangled nonwoven fabric in the same way as described in (1) in Reference Example 5. After the resulting nonwoven fabric was immersed into a warm water at 70° C. to shrink by 30% in area from the original size, the sea component (polyethylene) was melted whereby fibers were bonded together to form an entangled nonwoven fabric having smooth surfaces on both sides and having an apparent density of 0.35 g/cm$^3$ (which is hereinafter called Nonwoven Fabric (6)).

REFERENCE EXAMPLE 7

Preparation of a Fibrous Substrate Comprising Microfine Fiber-forming Fibers A sea-island type composite fibers (4 deniers in fineness, 15 island component fibers in the cross-section of fiber, 51 mm in length) comprising 70 by parts weight of polyethlene terephthalate and 30 by parts weight of polystyrene were treated in the same way as described in (1) in Reference Example 5 to form an entangled nonwoven fabric. After immersed into warm water at 70° C. to shrink by 30% in area from the original size, the nonwoven fabric was then subjected to heating to melt the sea component (polystyrene) causing fibers to be held together to form an entangled nonwoven fabric of an apparent density 0.32 g/cm$^3$ and having smooth surfaces (which is hereinafter called Nonwoven Fabric (7)).

REFERENCE EXAMPLE 8

Preparation of Fibrous Substrate Comprising Microfine Fibers

Polyvinyl alcohol was added to Nonwoven Fabric (7) obtained in Reference Example 7 to fix the shape of the fabric. The above nonwoven fabric was then immersed into toluene at 90° C., and squeezed 5 times with a press roll at 2 kg/cm$^2$ while being immersed to dissolve away the sea-component (polystyrene) in the sea-island type composite fibers. A microfine fibers bundles entangled nonwoven fabric made of polyethylene terephthalte of an apparent density of 0.23 g/cm$^3$ having smooth surfaces on both sides were obtained (which is hereinafter called Nonwoven Fabric (8)).

REFERENCE EXAMPLE 9

Preparation of Polyurethane Emulsion (1) Polyester diol (PMSA1850) in an amount of 546.3 g, 176.7 g of isophorone diisocyanate and 8.05 g of 2,2-bis (hydroxymethyl) propionic acid were placed in a three necked flask and stirred for 2 hours at 90° C. in a dry nitrogen atmosphere to form a prepolymer having isocyanate groups at the ends of the polymer chain.

(2) 2-Butanone in an amount of 236.0 g was added to the prepolymer thus prepared above in (1), and stirred homogeneously. After the temperature of the reactants in the flask was lowered to 40° C., 6.07 g of triethylamine, was added and stirred for 10 minutes. An aqueous solution prepared by dissolving 55.3 g of a nonionic surfactant ("EMULGEN985" manufactured by Kao Corp.) into 472.5 g of distilled water was added to the above and stirred for 1 min. with a homomixer to form an emulsion. An aqueous solution prepared by dissolving 12.8 g of diethylenetriamine, and 38.7 g of isophoronediamine into 203.2 g of distilled water was then immediately added to the above emulsion. The resulting mixture was then stirred with a homomixer for 1 minute to proceed with chain extending reaction. After 2-butanone was removed by a rotary evaporator, the same amount of distilled water was added to obtain a polyurethane emulsion of 46 wt. % solid.

(3) A heat gellable type polyurethane emulsion (hereinafter called Polyurethane Emulsion A) was prepared by mixing 80 parts by weight of the polyurethane emulsion obtained in (2) above and 20 parts by weight of distilled water, and 4 parts by weight of heat gelling agent {a solution mixed at 5:4:1 weight ratio with water:nonionic surfactant ("EMULGEN910" manufactured by Kao Corp.):calcium chloride)}.

(4) The heat gelling temperature of the Polyurethane Emulsion A obtained above in (3) was measured with the method described above and found to be 48° C. The Polyurethane Emulsion A was dried to give a film of 100 $\mu$m thickness. Modulus of elasticity at 90° C. and $\alpha$ dispersion temperature ($T_\alpha$) of the film thus obtained were measured. The results were $1.2\times10^8$ dyn/cm$^2$ and −46° C., respectively.

REFERENCE EXAMPLE 10

Preparation of Polyurethane Emulsion (1) A polyurethane emusion which does not contain heat gelling agent was prepared in the same way as described in (1) and (2) in Reference Example 9 (which is hereinafter called Polyurethane Emulsion B).

(2) Heat gelling temperature of the above Polyurethane Emulsion B was measured using the method described above, but the emulsion B was found to be fluid even at 90° C. A film was prepared from the above emulsion to be tested for modulus of elasticity and $\alpha$ dispersion temperature. The modulus of elasticity at 90° C. and $\alpha$ dispersion temperature of the film having a thickness of 100 $\mu$m were $1.2\times10^8$ dyn/cm$^2$ and −45° C., respectively.

REFERENCE EXAMPLE 11

Preparation of Polyurethane Emulsion (1) 333.9 g of Polyhexamethylene carbonatediol (PHC2000), 155.59 g of isophorone diiscyanate and 9.39 g of 2,2-bis(hydroxymethyl) propionic acid were placed in a three necked flask and stirred for 2 hours at 90° C. in a dry nitrogen atmosphere to obtain a urethane prepolymer having isocyanate group at the end of polymer chain.

(2) The urethane prepolymer obtained above in (1) was incorporated with 261.5 g of 2-butanone, and stirred homogeneously. After the temperature of the reactants in the flask was lowered to 40° C., 7.08 g of triethylamine was added to the solution, and then stirred for 10 min. An aqueous solution obtained by dissolving 61.14 g of nonionic surfactant ("EMULGEN985") into 520.8 g of distilled water was added to the above. The mixture thus obtained was stirred for a minute with a homomixer to give an emulsion, which was then incorporated with 13.73 g of diethylene triamine, 11.32 g of isophorone diamine and 228.9 g of water to proceed with chain extending reaction of the prepolymer. After removing 2-butanone with a rotary eveporator, the same amount of distilled water was added to give a polyurethane emulsion of 46% wt. solid.

(3) To 80 parts by weight of the polyurethane emulsion obtained above (2), was added 20 parts by weight of distilled water, and 0.8 part by weight of calcium chloride as heat gelling agent to give a heat gellable type polyurethane emulsion(which is hereinafter called Polyurethane Emulsion C).

(4) The heat gellation temperature of the Polyurethane Emulsion C was measured with the method described above and found to be 51° C. Modulus of elasticity at 90° C. and $\alpha$ dispersion temperature of the film having a thickness of 100 $\mu$m which was obtained by drying Polyurethane Emulsion C in (3) were $3.0\times10^7$ dyn/cm$^2$ and −33° C., respectively.

REFERENCE EXAMPLE 12

Preparation of a Polyurethane Emulsion (1) A heat gellable polyurethane emulsion (hereinafter called Polyurethane Emulsion D) was prepared using the same process described in Reference Example 9 except that the amount of isophorone diisocyanate was increased to increase the amount of the hard segment thereby adjusting a molar balance of other ingredients.

(2) Heat gelling temperature of Polyurethane Emulsion D obtained in (1) measured using the method described above was 45° C. Modulus of elasticity at 90° C. and $\alpha$ dispersion temperature of the film obtained by drying Polyurethane Emulsion D were $5.5\times10^8$ dyn/cm$^2$, and −30° C., respectively.

REFERENCE EXAMPLE 13

Preparation of a Polyurethane Emulsion (1) A heat gellable type polyurethane (hereinafter called Polyurethane Emulsion E) was prepared in the same way as practiced in (1) to(3) in Reference Example 11 except that the amount of isophorone diisocyanate used in (1) in Reference Example 11 was reduced to lower the content of the hard segment in the polyurethane whereby the molar balance of other ingredients were also changed accordingly.

(2) Heat gelling temperature of Polyurethane Emulsion E obtained above was measured and found to be 57° C. Mudulus of elasticity at 90° C. and $\alpha$ dispersion temperature of the film prepared by drying the above emulsion were found to be $1.6\times10^7$ dyn/cm$^2$ and −38° C., respectively.

REFERENCE EXAMPLE 14

Preparation of a Polyurethane Emulsion (1) Six hundreds grams of Polyester diol (PMSA1850), 114.8 g of 2,4-tolylenediisocyanate, and 7.95 g of 2,2-bis (hydroxymethyl) propionate were placed in a three necked flask, and stirred for 2 hours at 90° C. in a dry nitrogen atomosphere to form a urethane prepolymer having an isocyanate group at the end of the polymer chain.

(2) To the urethane prepolymer prepared above in (1), was added 228.3 g of 2-butanone and stirred for 10 min. An aqueous surfactant solution prepared by dissolving 53.3 g of nonionic surfactant ("Emulgen930" manufactured by Kao Corp.) into 478.5 g of distilled water was added to the above and stirred for 1 minute with a homomixer to form an emulsion. To the resulting emulsion was added an aqueous solution prepared by dissolving 13.2 g of diethylene triamine, and 10.9 g of isophorone diamine into 230.3 g of distilled water, and stirred for one minute with a homomixer to proceed with a chain extending reaction. After removing 2-butanone with a rotary evaporator, the same amount of distilled water was added to form a polyurethane emulsion of 40 wt. % solid.

(3) To 80 parts by weight of the polyurethane emulsion obtained above in (2) were added 20 parts by weight of distilled water and 4 parts by weight of heat gelling agent {water:nonionic surfactant ("Emulgen910"):calcium chloride=5:4:1} to obtain a heat gellable polyurethane (hereinafter called "Polyurethane Emulsion F").

(4) Heat gelation temperature of the above Polyurethane Emulsion F was 52° C. A film having a thickness of 100 $\mu$m obtained by drying the above emulsion gave modulus of elasticity at 90° C. and 160° C. of $5.0\times10^7$ dyn/cm$^2$ and $3.5\times10^7$ dyn/cm$^2$, respectively. $\alpha$ Dispersion temperature (T$\alpha$) of the same film was also measured and found to be −47° C.

REFERENCE EXAMPLE 15

Preparation of Polyurethane Emulsion (1) Polyurethane emulsion which does not contain heat gelling agent were prepared in the same way as described in (1) and (2) in Reference Example 14. This emulsion is hereinafter called "Polyurethane Emulsion G".

(2) Heat gelation temperature, modulus of elasticity, and $\alpha$ dispersion temperature were measured as described earlier and the result is shown in Table 2.

REFERENCE EXAMPLE 16

Preparation of Polyurethane Emulsion (1) A heat gellable polyurethane emulsion was prepared in the same way as practiced in Reference Example 14 except that the amount of tolylenediisocyanate was reduced to lower the content of hard segment in the polyurethane. Accordingly, the amount of other ingredients were also adjusted. The emulsion thus obtained is hereinafter called "Polyurethane Emulsion H".

(2) The test results of the above emulsion are shown in Table 2.

REFERENCE EXAMPLE 17

Preparation of a Polyurethane Emulsion (1) To a three necked flask were added 238.5 g of polyhexamethylene carbonatediol (PHC2000), 238.5 g of polyesterdiol (PMSA1850), 200.0 g of 4,4'-diphenylmenthane diisocyanate, and 8.05 g of 2,2-bis (hydroxymethyl) propionic acid. The mixture was stirred in a dry nitrogen atmosphere for 2 hours at 70° C. to form a urethane prepolymer having isocyanate groups at the end of the polymer chain.

(2) To the prepolymer obtained above in (1) was added 224.1 g. of toluene. The mixture was stirred to form a homogeneous solution, and then cooled to 40° C. After 6.07 g. of triethylamine was added, the mixture was stirred for 10 min. An aqueous surfactant solution prepared by dissolving 37.50 g. of a nonionic surfactant ("Emulgen 930") into 675 g. of distilled water was added to the above mixture and stirred with a homomixer for 1 minute to emulsify the mixture. An aqueous solution prepared by dissolving 14.41 g. of diethyltriamine and 43.6 g. of isophorone diamine in 221.4 g. of distilled water was added to the above emulsion to proceed with the chain extending reaction. After the chain extending reaction, toluene was removed by a rotary eveporator. Distilled water was added to adjust the solid to give a polyurethane emulsion of 40 weight % solid.

(3) To 80 parts by weight of the polyurethane emulsion obtained above in (2) were added 20 parts by weight of distilled water and 0.8 part by weight of calcium chloride as a heat gelling agent. The resulting heat gellable type polyurethane emulsion is hereinafter called "Polyurethane Emulsion I".

(4) The test results of the above emulsion are shown in Table 2.

REFERENCE EXAMPLE 18

Preparation of a Polyurethane (1) A heat gellable type polyurethane emulsion was made by following the procedure used in (1) to (3) in Reference Example 17 except that the amount of 4,4'-diphenylmethane diisocyanate was increased to increase the content of hard segment in the polyurethane. Accordingly the amount of other ingredients used were also adjusted. The heat gellable polyurethane emulsion thus obtained is hereinafter called "Polyurethane Emulsion J".

(2) The test results of the above emulsion are summarized in Table 2.

REFERENCE EXAMPLE 19

Preparation of a Polyurethane (1) A heat gellable type polyurethane emulsion was prepared in the manner described in (1) to (3) in Reference Example 17 except that the amount of 4,4'-diphenylmethane diisocyanate was reduced to lower the content of hard segment in the polyurethane. Accordingly, the amount of other ingredients used were also adjusted. The heat gellable polyurethane emulsion thus obtained will be hereinafter called "Polyurethane Emulsion K".

(2) The test results of the Polyurethane Emulsion K are summarized in Table 2.

REFERENCE EXAMPLE 20

Preparation of a Polyurethane Emulsion (1) A heat gellable polyurethane emulsion was prepared in the same manner as described in (1) to (3) in Reference Example 14 except that the amount of 2,4-tolylenediisocyanate was reduced to decrease the content of hard segment in the polyurethane. Accordingly, the amount of other ingredients used were also adjusted. The emulsion thus prepared is now hereinafter called "Polyurethane Emulsion L".

(2) The test results of Polyurethane Emulsion L are shown in Table 2.

EXAMPLE 1

Preparation of a Leather-like Sheet (1) The Nonwoven Fabric (1) pretreated with a water repellent softening agent and obtained in Reference Example 1 was immersed in the heat gellable Polyurethane A obtained in Reference 9. After being impregnated, the nonwoven fabric was squeezed with a press roll and then dipped into a warm water at 90° C. for one minute to coagulate the polyurethane emulsion. A sheet thus obtained was dried at 130° C. for 30 minutes in a heated air dryer.

(2) The amount of resin deposited on the sheet obtained above in (1) was 66 wt. % based on the weight of the nonwoven fabric used. Flexibility measured in terms of flexural rigidity and hand touch of the sheet obtained above in (1) were evaluated. Evaluation results of the sheet are shown in Table 1.

(3) A cross-section of the sheet obtained in (1) was observed with an electron microscope. A detailed structure is seen in the photograph taken through the electron microscope shown in FIG. 2. As is evident from FIG. 2, polyurethane is coagulated as particles instead of binding fibers in the fibrous substrate, thereby providing the sheet with a desired softness and flexibility together with a fulfillment feeling required in giving hand touch of natural leather.

EXAMPLE 2

Preparation of a Leather-like Sheet (1) A leather-like sheet was prepared in the same manner as described in (1) in Example 1 except that heat gellable Polyurethane Emulsion C obtained in Reference Example 11 was used.

(2) The amount of resin deposited on the leather-like sheet obtained in (1) above was 65 wt. % based on the weight of nonwoven fabric used. Evaluation results for the sheet obtained above are summarized in Table 1.

EXAMPLE 3

Preparation of a Leather-like Sheet (1) A leather-like sheet was prepared in the same manner as described in (1) in Example 1 except that a nonwoven fabric pretreated with a water repellent softening agent described in Reference Example 3 was used.

(2) The amount of resin deposited on the sheet was 30 wt. % based on the weight of nonwoven fabric used. Table 1 summarizes the result of evaluation made on the sheet thus obtained above.

COMPARATIVE EXAMPLE 1

Preparation of a Leather-like Sheet (1) A leather-like sheet was prepared in the same manner as described in (1) in Example 1 except that Polyurethane Emulsion B which does not contains a heat gelling agent as described in Reference Example 10 was used. It was noted that a whity water of polyurethane emulsion came out to the warm water bath during the coagulating process.

(2) The amount of resin deposited on the sheet obtained above in (1) was 25 wt. % based on the weight of nonwoven fabric used. The results of the evaluation of the sheet thus obtained are summarized in Table 1. The sheet exhibited hand touch almost like nonwoven fabric lacking infulfillment feeling, and showed locally exsisting hard sections. On the whole, the sheet showed a hand touch quite different from those of natural leather.

COMPARATIVE EXAMPLE 2

Preparation of a Leather-like Sheet (1) A leather-like sheet was prepared in the manner described in (1) in Example 1 except that Nonwoven Fabric (2), which was not pretreated with a water repellent softening agent as described in Reference Example 2, was used.

(2) The amount of resin(polyurethane) deposited on the sheet was 64 wt. % based on the weight of nonwoven fabric used. The results of evaluation of the sheet thus obtained are shown in Table 1. Although the sheet exhibited considerable fulfillment feeling, it lacked in softness and being far inferior in terms of hand touch.

COMPARATIVE EXAMPLE 3

Preparation of a Leather-like Sheet (1) A leather-like sheet was prepared in the same manner as described in (1) in Example 1 except that Polyurethane Emulsion D containing a heat gelling agent as described in Reference Example 12 was used.

(2) The amount of resin (polyurethane) deposited on the sheet was 62 wt. % based on the weight of nonwoven fabric used. The results of evaluation of the sheet thus obtained are shown in Table 1. Hand touch of the sheet were found to be hard and undesirable.

COMPARATIVE EXAMPLE 4

Preparation of a Leather-like Sheet (1) A leather-like sheet was prepared in the same manner as described in (1) in Example 1 except that Polyurethane emulsion E containing a heat gelling agent obtained in Reference Example 13 was used.

(2) The amount of resin(polyurethane) deposited on the sheet was 68 wt. % based on the weight of nonwoven fabric used. The results of evaluation of the sheet obtained are shown in Table 1. The sheet exhibited soft hand, but lacked in fulfillment feeling.

Figure 3:
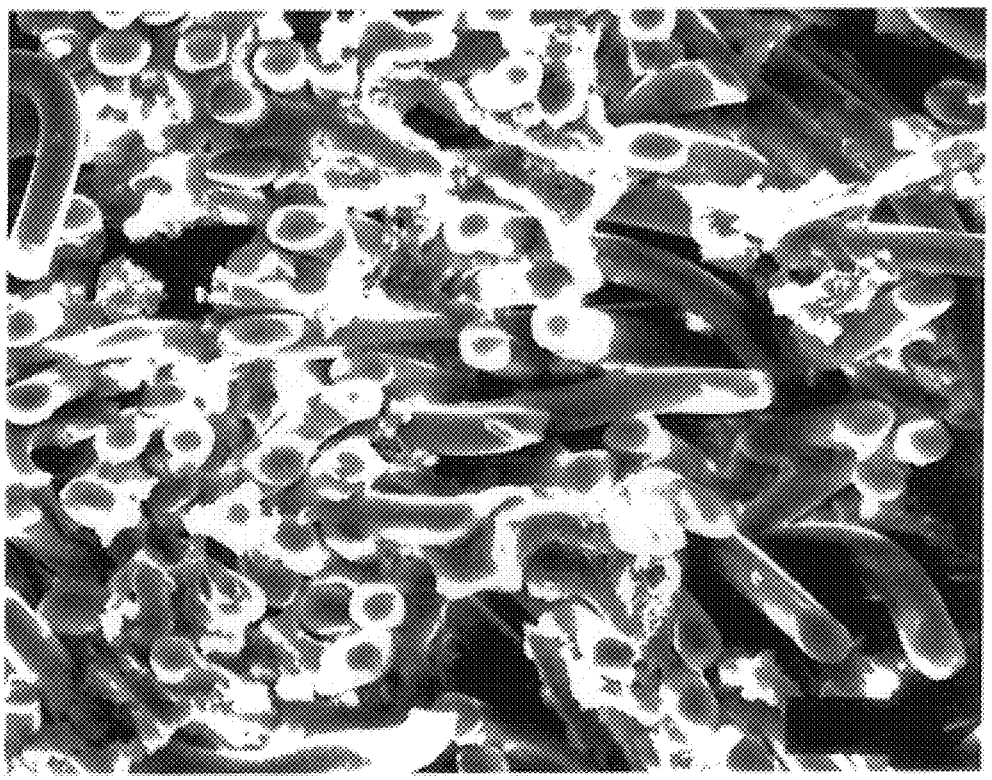
FIG. 3 is an electron micrograph taken of a cross-section of a leather-like sheet obtained in Comparative Example 4.

(3) A cross-section of the sheet obtained in this Comparative Example was observed with an electron microscope. An electron micrograph taken shows the detailed structure of the cross-section of the sheet as shown in FIG. 3. As is evident from FIG. 3, polyurethane is not uniformly dispersed in the fibrous substrate, thereby binding fibers locally and causing the sheet lacking in fulfillment feeling.

COMPARATIVE EXAMPLE 5

Preparation of a Leather-like Sheet (1) A leather-like sheet was obtained in the same manner as described in (1) in Example 1 except that in this case Nonwoven Fabric (3) obtained in Reference Example 3 and Polyurethane Emulsion D obtained in Reference Example 12 were used.

(2) The amount of resin deposited on the sheet was found to be 27 wt. % based on the weight of nonwoven fabric used. The results of evaluation of the sheet obtained are shown in Table 1. As is evident from Table 1, the sheet exhibited inferior hand touch lacking in softness.

COMPARATIVE EXAMPLE 6

Preparation of a Leather-like Sheet (1) A leather-like sheet was prepared in the manner described in (1) in Example 1 except that in this case Nonwoven Fabric (3) containing water repellent softening agent obtained in Reference Example 13 and Polyurethane Emusion E pretreated with a heat gelling agent obtained in Reference Example 13 were used.

(2) The amount of resin (polyurethane) deposited on the sheet was 30 wt. % based on the weight of nonwoven fabric used. The results of evaluation of the sheet obtained are summarized in Table 1. As is evident from the data, the fulfillment feeling and hand touch of the sheet were inferior.

COMPARATIVE EXAMPLE 7

Preparation of a Leather-like Sheet (1) A leather-like sheet was prepared in the manner described in (1) in Example 1 except that in this case Nonwoven Fabric (4) without any water repellent softening agent obtained in Reference Example 4 and Polyurethane Emulsion A with a heat gelling agent obtained in Reference Example 9 were used.

(2) The amount of resin deposited on the sheet was found to be 32 wt. % based on the weight of nonwoven fabric used. The hand touch of the sheet obtained was hard and rated unsatisfactory as shown in Table 1.

Furthermore, Comparative Examples 2 and 7 showed that the use of substrate without a treatment with water repellent softening agent gave sheets of hard hand touch, and of poor appearance.

As shown in Comparative Examples 3 and 5, when a polyurethane emulsion used gave film having a mudulus of elasticity higher than $5.0\times10^8$ dyn/cm$^2$ at 90° C., the resulting sheets exhibited inferior quality of hard hand touch feel.

On the other hand, Comparative Examples 4 and 6 showed that if a polyurethane emulsions used gave a film having a modulus of elasticity less than $2.0\times10^7$ dyn/cm$^2$ at 90° C., the sheet obtained exhibited hand touch of nonwoven fabric without fulfillment feeling.

EXAMPLE 4

Preparation of a Leather-like Sheet (1) Nonwoven Fabric (5) described in Reference Example 5 was immersed into a bath containing the heat gellable type Polyurethane Emulsion F described in Reference Example 14 and subjected to impregnation. After taken out from the bath, the impregnated sheet was squeezed with a press roll, and then dipped into a warm water bath of 90° C. for 1 minute causing the emulsion to coagulate, and finally dried at 130° C. for 30 min. in a heated air dryer.

(2) The sheet obtained in (1) above was immersed into toluene, and squeezed 5 times with a press roll at 2 kg/cm$^2$ while being immersed to dissolve away the sea component (polyethylene) in the sea-island type mixed spun fibers leaving a nonwoven fabric constituted of entangled microfine fiber bundles of Nylon-6 containing coagulated polyurethane. The sheet thus obtained contained 55 wt. % of the resin (polyurethane) based on the weight of nonwoven fabric after microfine fiber formation.

(3) Table 2 summarizes the results of evaluation made on the sheet obtained in (1) above.

As is evident from the data in Table 2, the sheet exhibited excellent hand touch with desired softness and fulfillment feeling similar to natural leather as well as excellent durability.

TABLE 1

| | Nonwoven fabric | | Polyurethane emulsion | | | | Sheet[3] | |
|---|---|---|---|---|---|---|---|---|
| Examples | Category | Water-repellent softening treatment | Category | Heat gelation temperature(° C.) | Modulus of elasticity (dyn/cm$^2$)[1] | α dispersion temperature (Tα)(° C.)[2] | flexural rigidity (gfcm/$^2$cm) | hand touch |
| Example 1 | ① (Ref. Example 1) | Yes | A (Ref. Example 9) | 48 | $1.2\times10^8$ | −46 | 5.4 | ○ |
| Example 2 | ① (Ref. Example 1) | Yes | C (Ref. Example 11) | 51 | $3.0\times10^7$ | −33 | 4.2 | ○ |
| Example 3 | ③ (Ref. Example 3) | Yes | A (Ref. Example 9) | 48 | $1.2\times10^8$ | −46 | 6.5 | ○ |
| Comp. Example 1 | ① (Ref. Example 1) | Yes | B (Ref. Example 10) | >90 | $1.2\times10^8$ | −45 | 7.5 | x |
| Comp. Example 2 | ② (Ref. Example 2) | No | A (Ref. Example 9) | 48 | $1.2\times10^8$ | −46 | 9.5 | x |
| Comp. Example 3 | ① (Ref. Example 1) | Yes | D (Ref. Example 12) | 45 | $5.5\times10^8$ | −30 | 9.3 | x |
| Comp. Example 4 | ① (Ref. Example 1) | Yes | E (Ref. Example 13) | 57 | $1.6\times10^7$ | −38 | 3.8 | x |
| Comp. Example 5 | ③ (Ref. Example 3) | Yes | D (Ref. Example 12) | 45 | $5.5\times10^8$ | −30 | 10.3 | x |
| Comp. Example 6 | ③ (Ref. Example 3) | Yes | E (Ref. Example 13) | 57 | $1.6\times10^7$ | −38 | 4.5 | x |
| Comp. Example 7 | ④ (Ref. Example 4) | No | A (Ref. Example 9) | 48 | $1.2\times10^8$ | −46 | 8.8 | x |

[1]Modulus of elasticity measured at 90° C. on the film obtained by drying the subject polyurethane emulsion at 50° C. of 100 μm thickness.
[2]α dispersion temperature (Tα) of the film obtained by drying the subject polyurethane emulsion at 50° C. of 100 μm thickness.
[3]Physical property and hand touch of leather-like sheet As shown in Examples (1) to (3) and Comparative Examples (1) to (7), leather-like sheets obtained in Examples (1) to (3) by impregnating Fibrous Substrate(I) with Polyurethane Emulsion (I) followed by coagulation exhibited desirable hand touch with adequate softness and fulfillment feeling similar to those of natural leather, wherein Fibrous Substrate (I) was pretreated with a fiber treatment agent (water repellent softening agent) which can inhibit adhesion between polyurethane and fibers, and Polyurethane Emulsion (I) was a heat gellable type which upon drying formed film having a modulus of elasticity at 90° C. of $2.0\times10^7$ dyn/cm$^2$ to $5.0\times10^8$ dyn/cm$^2$.

On the other hand, as shown in Comparative Example 1, even if Fibrous Substrate (I) with water repellent softening agent was used in combination with a polyurethane emulsion of non-heat gellable type, polyurethane emulsion impregnated in the substrate leached out to the coagulation bath without being held in the substrate. This caused to give a sheet of inferior quality lacking in desired hand touch and appearance.

(4) A cross-section of the sheet obtained in (2) in Example 4 above was observed with an electron microscope. FIG. 4 is a photograph taken through the electron microscope showing the detailed structure of the sheet. As is evident from FIG. 4, coagulated polyurethane fills the interspaces among microfine fiber bundles, at the same time, leaving adequate open spaces without binding microfine fibers too tightly in the substrate. It is believed that this is the reason for the excellent softness and fulfillment feeling obtained. The sheet thus obtained had excellent hand touch similar to those of natural leather.

EXAMPLE 5

Preparation of a Leather-like Sheet (1) A sheet was prepared as in (1) in Example 4 but with the heat gellable Polyurethane Emulsion I in Reference Example 17.

(2) The sheet obtained in (1) above was immersed in toluene at 90° C. and squeezed with a press roll at 2 kg/cm$^2$ 5 times while being immersed to dissolve away the sea component (polyethylene) of the sea-island type composite spun fibers leaving non-woven fabric constituted of entangled microfine fiber bundles of polyethylene terephthalate containing coagulated polyurethane. The sheet thus obtained contained 50 wt. % of resin based on the total weight of non-woven fabric after microfine fiber formation.

(3) The test results on the sheet obtained above are summarized in Table 2. The sheet had excellent hand touch with adequate softness and fulfillment feeling similar to those of natural leather as well as an excellent durability.

EXAMPLE 6

Preparation of a Leather-like Sheet (1) The non-woven fabric obtained in Reference Example 7 was immersed into a penetrant surfactant solution made of 10 parts by weight of polyethylene glycol-mono-4-nonylphenol ether (number-average molecular weight of polyethylene glycol portion was 330) and 90 parts by weight of distilled water. After being immersed, the sheet was squeezed with a press roll. The amount of the surfactant added to the sheet was 8 wt. % as the solution.

(2) The non-woven fabric obtained above in (1) was immersed into Polyurethane Emulsion I in Reference Example 17. After being squeezed with a press roll, the sheet was sprayed with a steam of 1.5 kg/cm$^2$ to cause coagulation of the polyurethane emulsion, and then dried at 130° C. for 30 minutes in a heated-air drier.

(3) The sheet obtained in (2) was immersed into toluene at 90° C. and squeezed 5 times at 2 kg/cm$^2$ with a press roll during the immersion to dissolve away the sea component (polystyrene) of the sea-island type composite spun fibers constituting the non-woven fabric leaving a sheet made of micofine fiber bundles of polyethylene terephthalate containing coagulated polyurethane. The amount of polyurethane in the sheet was 60 wt. % based on the weight of non-woven fabric after microfine fiber formation.

(4) The test results on the sheet obtained above are summarized in Table 2. The sheet exhibited natural leather-like hand touch with excellent durability.

EXAMPLE 7

Preparation of a Leather-like Sheet (1) Non-woven Fabric (6) obtained in Reference Example 6 was used as a substrate and impregnated with Polyurethane Emulsion F obtained in Reference Example 14. After squeezed with a press roll, the sheet was dried at 130° C. for 30 minutes.

(2) The sheet obtained above in (1) was immersed into toluene and squeezed 5 times at 2 kg/cm$^2$ with a press roll to dissolve away the sea component (polyethylene) leaving non-woven fabric composed of microfine fiber bundles of polyethylene terephthalate containing coagulated polyurethane. The resulting sheet contained 42 wt. % of polyurethane based on the weight of non-woven fabric after microfine fiber formation.

(3) The test results on the sheet obtained above are summarized in Table 2. The sheet exhibited natural leather like hand touch as well as excellent durability.

COMPARATIVE EXAMPLE 8

Preparation of a Leather-like Sheet (1) A sheet was prepared as in (1) in Example 4 except that in this case Non-woven Fabric (5) in Reference Example 5 was impregnated with Polyurethane Emulsion G in Reference Example 15. When the non-woven fabric impregnated with polyurethane emulsion was dipped into a warm water bath, polyurethane emulsion leached out from the sheet into the bath.

(2) The sheet obtained above was immersed into toluene as in described in (2) in Example 4 to dissolve away the sea component (polyethylene) to leave microfine fiber bundles of Nylon-6 with coagulated polyurethane. The amount of polyurethane in the sheet was 35 wt. % based on the weight of non-woven fabric after microfine fiber formation.

(3) The sheet obtained above was a flattened paper-like sheet without fulfillment feeling. The test results on this sheet are shown in Table 2.

COMPARATIVE EXAMPLE 9

Preparation of a Leather-like Sheet (1) A sheet was prepared as in (1) in Example 4 but in this case with Polyurethane Emulsion H obtained in Reference Example 16.

(2) The sheet obtained above in (1) was immersed into toluene as described in (2) in Example 4 to dissolve away the sea component (polyethylene) of the sea-island type mixed spun fibers leaving the non-woven fabric composed of microfine fiber bundles of Nylon-6 and coagulated polyurethane. The amount of polyurethane in the sheet was found to be 58 wt. % based on the weight of non-woven fabric after the microfine fiber formation.

(3) The evaluation results on sheet obtained above are shown in Table 2. The sheet was a flattened paper-like sheet without fulfillment feeling.

Figure 5:
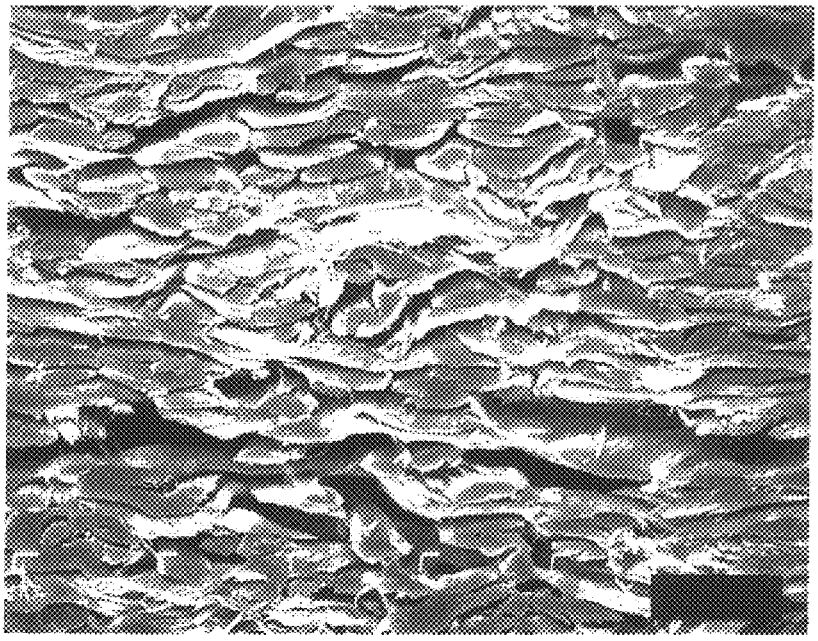
FIG. 5 is an electron micrograph taken of a cross-section of a leather-like sheet obtained in Comparative Example 9.

(4) An electron micrograph of a cross-section of the sheet obtained in Comparative Example 9 above is shown in FIG. 5, which shows the detailed structure of the sheet. As is evident from the photograph, microfine fibers are bound tightly together by polyurethane hardly leaving a space among the microfine fiber bundles in the substrate. The entire sheet appeared flattened.

COMPARATIVE EXAMPLE 10

Preparation of a Leather-like Sheet (1) A sheet was prepared as in (1) in Example 4 except that Nonwoven Fabric (6) in Reference Example 6 and Polyurethane Emulsion J in Reference Example 18 were used in this case.

(2) The sheet thus obtained in (1) above was immersed into toluene as in (2) in Example 4 to dissolve away the sea component (polyethylene) in the sea-island type composite spun fibers used leaving a non-woven fabric composed of microfine fiber bundles of polyethylene terephthalate with coagulated polyurethane. The sheet obtained above contained 50 wt. % of resin based on the weight of non-woven fabric after microfine fiber formation.

(3) The results of evaluation of the above sheet are shown in Table 2. The leather-like sheet obtained in (2) above had no softness having a hard hand touch.

COMPARATIVE EXAMPLE 11

Preparation of a Leather-like Sheet (1) A sheet was prepared as in (1) in Example 4 but using Non-woven Fabric (7) in Reference Example 7 and Polyurethane Emulsion K in Reference Example 19.

(2) As described in (2) in Example 4 the sheet obtained above in (1) was immersed in toluene causing the sea component (polystyrene) to dissolve away leaving non-woven fabric composed of microfine fiber bundles of polyethylene terephthalate with coagulated polyurethane. The sheet thus obtained was found to contain 56 wt. % of polyurethane based on the weight of non-woven fabric after microfine fiber formation.

(3) The test results on the sheet obtained above are summarized in Table 2. The sheet had hard surface and inferior hand touch lacking in softness.

COMPARATIVE EXAMPLE 12

Preparation of a Leather-like Sheet (1) A sheet was prepared as in (1) in Example 7 except that in this case Non-woven fabric (6) in Reference Example 6 and Polyurethane Emulsion L in Reference Example 20 were used.

(2) The sheet obtained above was immersed into toluene in the manner described in (2) in Example 4. The sea component (polyethylene) in sea-island type fibers was dissolved away leaving a sheet composed of microfine fiber bundles of polyethylene terephthalte with coagulated polyurethane. The amount of resin (polyurethane) in the sheet was 43 wt. % based on the weight of non-woven fabric after microfine fiber formation.

(3) The results of evaluation on the sheet obtained above are shown in Table 2. The sheet was hard and exhibited inferior hand touch.

COMPARATIVE EXAMPLE 13

Preparation of a Leather-like Sheet (1) Non-woven Fabric (8) in Reference Example 8 was impregnated with Polyurethane Emulsion I in Reference Example 17 and squeezed with a press roll. A steam of 1.5 kg/cm$^2$ was sprayed onto the impregnated sheet to coagulate polyurethane emulsion. The polyvinyl alcohol used was removed by washing with warm water. The resulting sheet was dried at 130° C. for 30 min. The sheet thus obtained contained 60 wt. % of resin based on the weight of non-woven fabric.

(2) Table 2 shows the results of evaluation of the sheet obtained above. The sheet had adequate fulfillment feeling, but exhibited rather hard hand touch.

TABLE 2

| | | Polyurethane emulsion | | | | | Leather-like sheet | | |
|---|---|---|---|---|---|---|---|---|---|
| | Non-woven | | Heat gelation | Modulus of elasticity[1)] | | α dispersion | | Bending fatigue | |
| Examples | fabric Category | Category | temperature (° C.) | 90° C. (dyn/cm$^2$) | 160° C. (dyn/cm$^2$) | temperature (Tα)(° C.) | Flexural rigidity | resistance (10,000 times) | hand touch |
| Example 4 | 5 (Ref. Ex. 5) | F (Ref. Ex. 14) | 52 | $5.0 \times 10^7$ | $3.5 \times 10^7$ | −47 | 4.3 | ○ | ○ |
| Example 5 | 6 (Ref. Ex. 6) | I (Ref. Ex. 17) | 48 | $3.0 \times 10^8$ | $5.5 \times 10^7$ | −35 | 5.5 | ○ | ○ |
| Example 6 | 7 (Ref. Ex. 7) | I (Ref. Ex. 17) | 48 | $3.0 \times 10^8$ | $5.5 \times 10^7$ | −35 | 4.7 | ○ | ○ |
| Example 7 | 6 (Ref. Ex. 6) | F (Ref. Ex. 14) | 56 | $5.0 \times 10^7$ | $3.5 \times 10^7$ | −47 | 5.0 | ○ | ○ |
| Comp. Example 8 | 5 (Ref. Ex. 5) | G (Ref. Ex. 15) | >90 | $5.0 \times 10^7$ | $3.5 \times 10^7$ | −47 | 10.2 | ○ | x |
| Comp. Example 9 | 5 (Ref. Ex. 5) | H (Ref. Ex. 16) | 56 | $1.6 \times 10^7$ | $7.0 \times 10^6$ | −42 | 8.5 | 40 | x |
| Comp. Example 10 | 6 (Ref. Ex. 6) | J (Ref. Ex. 18) | 45 | $5.8 \times 10^8$ | $8.2 \times 10^7$ | −25 | 8.3 | 30 | x |
| Comp. Example 11 | 7 (Ref. Ex. 7) | K (Ref. Ex. 19) | 56 | $1.5 \times 10^7$ | $1.1 \times 10^7$ | −40 | 10.5 | 50 | x |
| Comp. Example 12 | 6 (Ref. Ex. 6) | L (Ref. Ex. 20) | 55 | $2.2 \times 10^7$ | $9.0 \times 10^6$ | −48 | 9.1 | ○ | x |
| Comp. Example 13 | 8 (Ref. Ex. 8) | I (Ref. Ex. 17) | 48 | $3.0 \times 10^8$ | $5.5 \times 10^7$ | −35 | 7.8 | 50 | x |

[1)]Modulus of elasticity measured at 90° C. and 160° C. on the film of 100 μm thickness obtained by drying the subject polyurethane emulsion at 50° C.

[2)]α dispersion temperature (Tα) of the film of 100 μm thickness obtained by drying the subject polyurethane emulsion at 50° C.

[3)]Unit: gfcm$^2$/cm

As is evident from the data shown in Examples 4 to 7 and Comparative Examples 8 to 12, a leather-like sheet in Examples 4 to 7 obtained by impregnating a fibrous substrate composed of microfine fiber-forming fibers with a thermoplastic Polyurethane Emusion meeting the previously defined conditions (i) to (iv) and then converting the fibers to microfine fibers has adequate softness, fulfillment feeling, and hand touch similar to those of natural leather as well as excellent bending fatigue resistance and durability.

On the other hand, the sheet obtained in Comparative Examples 8 to 12 where polyurethane emulsion used did not meet the conditions (i) to (iv) gave higher flexural rigidity than those obtained in Examples 4 to 7,and harder texture showing inferior hand touch. Further, the sheet obtained in Comparative Examples 9 to 11 showed inferior bending fatigue resistance and poor durability. In Reference Example 13, microfine fiber formation step was made before impregnation step with polyurethane emulsion. In this case, the sheet obtained gave a higher flexural strength than those obtained in Examples 4 to 7, and had harder texture showing inferior hand touch.

What is claimed is:

1. A process for making a leather-like sheet comprising pretreating a fibrous substrate with a fiber treatment agent which inhibits adhesion between fibers and polyurethane, impregnating the pretreated fibrous substrate with a polyurethane emulsion, followed by coagulating the polyurethane emulsion, wherein the polyurethane emulsion is heat gellable, and a film having a thickness of 100 $\mu$m obtained by drying the polyurethane emulsion at 50° C. has a modulus of elasticity of $2.0\times10^7$ to $5.0\times10^8$ dyn/cm$^2$ at 90° C.

2. The process of claim 1, wherein the fiber treatment agent is a water repellent softening agent comprising a mixture of a dimethylpolysiloxane and at least one member selected from the group consisting of methylhydrogen polysiloxanes and polysiloxanes having a methylhydrogensiloxy unit and a dimethylsiloxy unit.

3. The process of claim 1 or 2, wherein a film having a thickness of 100 $\mu$m obtained by drying said polyurethane emulsion at 50° C. has an $\alpha$ dispersion temperature of lower than −10° C.

4. The process of claim 1, wherein the fibrous substrate is a non-woven fabric having a density of 0.25 to 0.50 g/cm$^2$ comprising shrinkable polyethylene terephthalate fibers.

5. A process for making a leather-like sheet comprising the steps of:

(a) impregnating a fibrous substrate comprising microfine fiber-forming fibers with a polyurethane emulsion, wherein the polyurethane emulsion is heat gellable, a film having a thickness of 100 $\mu$m obtained by drying the polyurethane emulsion at 50° C. has a modulus of elasticity of $2.0\times10^7$ to $5.0\times10^8$ dyn/cm$^2$ at 90° C., a modulus elasticity of at least $1.0\times10^7$ dyn/cm$^2$ at 160° C., and an $\alpha$ dispersion temperature ($T_\alpha$) of −30° C. or lower, (b) coagulating the polyurethane emulsion; and converting the microfine fiber-forming fibers to microfine fibers.

6. The process of claim 5, wherein said polyurethane emulsion is made with an aromatic isocyanate.

7. The process of claim 5, wherein said fibrous substrate is pretreated with a penetrant surfactant prior to the impregnation with polyurethane emulsion.

8. The process of claim 5, 6, or 7, wherein said microfine fiber-forming fibers are sea-island type composite spun fibers and/or sea-island type mixed spun fibers comprising at least two polymeric materials, wherein after the impregnation with the polyurethane emulsion and coagulation of the polyurethane emulsion, the microfine fiber-forming fibers are subjected to a microfine fiber-forming step in which a sea component in the sea-island type composite spun fibers and/or the sea-island type mixed spun fibers is removed.

9. The process of claim 8, wherein the microfine fiber-forming fibers comprise polyethylene and/or polystyrene as a sea component and polyethylene terephthalate and/or polyamide as an island component, wherein the sea component of the microfine fiber-forming fibers is removed by an organic solvent, thereby forming microfine fibers.

10. The process of claim 1 or 5, wherein the heat-gellable polyurethane emulsion is a polyurethane emulsion containing a heat gellable agent.

11. The process of claim 1 or 5, wherein the coagulation of the polyurethane emulsion impregnated into the fibrous substrate is carried out in warm water at a temperature of at least 70° C. or in a steam atmosphere.

* * * * *

UNITED STATES PATENT AND TRADEMARK OFFICE

CERTIFICATE OF CORRECTION

PATENT NO. : 6,322,851 B1
DATED : November 27, 2001
INVENTOR(S) : Hideaki Adachi et al.

It is certified that error appears in the above-identified patent and that said Letters Patent is hereby corrected as shown below:

Column 32,
Line 2, should read:
-- a non-woven fabric having an apparent density of 0.25 to 0.50 g/cm$^3$ --

Signed and Sealed this

First Day of April, 2003

JAMES E. ROGAN
*Director of the United States Patent and Trademark Office*